US007878955B1

(12) United States Patent
Ehrlich et al.

(10) Patent No.: US 7,878,955 B1
(45) Date of Patent: Feb. 1, 2011

(54) INTEGRATED RESISTANCE SPRING FORCE MACHINE

(76) Inventors: Michael J. Ehrlich, 15305 Juniper Ct., Pine Mountain Club, CA (US) 93222; Kirk T. Lemmon, 12100 Wilshire Blvd., No. 445, Los Angeles, CA (US) 90025; Dean G. Tornabene, 4051 Glencoe Ave., Unit 8, Marina del Rey, CA (US) 90292

( * ) Notice: Subject to any disclaimer, the term of this patent is extended or adjusted under 35 U.S.C. 154(b) by 128 days.

(21) Appl. No.: 12/315,549

(22) Filed: Dec. 4, 2008

(51) Int. Cl.
*A63B 21/045* (2006.01)

(52) U.S. Cl. ..... 482/127

(58) Field of Classification Search ..... 482/92, 482/116, 121, 127, 129; 242/373, 375; 119/796; 473/142, 226–229, 257–258, 422, 431; *A63B 21/02, A63B 21/045*

See application file for complete search history.

(56) References Cited

U.S. PATENT DOCUMENTS 5,269,512 A * 12/1993 Crowson et al. ..... 473/457
6,126,580 A * 10/2000 Francis et al. ..... 482/114
6,440,044 B1 * 8/2002 Francis et al. ..... 482/114
6,685,602 B2 * 2/2004 Colosky et al. ..... 482/127
6,929,589 B1 * 8/2005 Bruggemann et al. ..... 482/138

* cited by examiner

*Primary Examiner*—Loan Thanh
*Assistant Examiner*—Oren Ginsberg
(74) *Attorney, Agent, or Firm*—Thomas I. Rozsa

(57) ABSTRACT

An integrated resistance spring force assembly machine which is incorporated into an exercise machine and having a plurality of internal transverse sections with each section having respective constant force springs to output a respective magnitude of a spring resistance force, which serves as the respective force loads when in use, and a force selection mechanism which can be used to selectively activate the respective springs so that the respective force loads can be output to a combined level of resistance for an exercise routine.

17 Claims, 11 Drawing Sheets

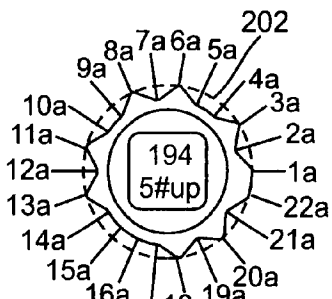
FIG. 6a
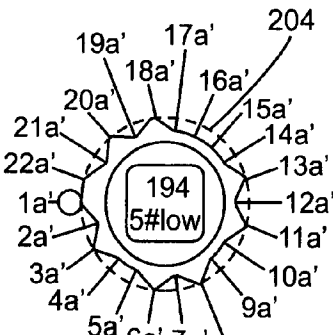
FIG. 6b
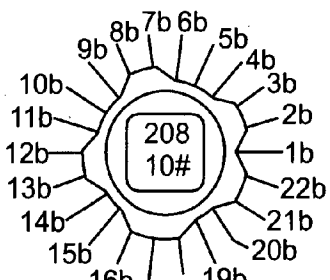
FIG. 6c
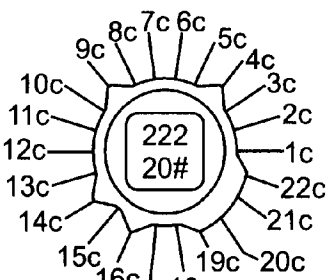
FIG. 6d
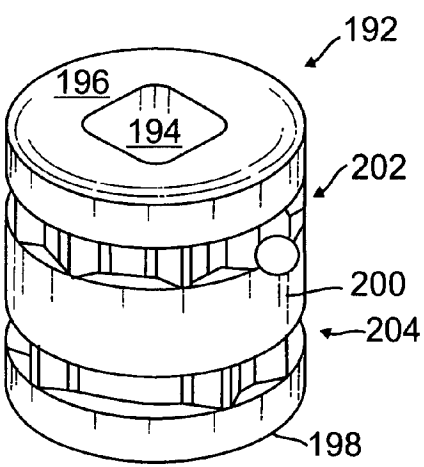
FIG. 7
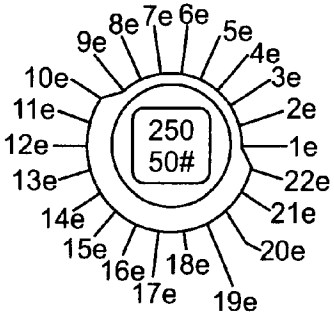
FIG. 6e
FIG. 6f

INTEGRATED RESISTANCE SPRING FORCE MACHINE

BACKGROUND OF THE INVENTION

1. Field of the Invention

The present invention is related to the field of mechanical resistance forces used with exercise machines to provide resistance forces when a user is engaged in physical exercise during the time when the machine is in use.

2. Description of the Prior Art

In general, mechanical exercise devices which enable a user to select a specific amount of resistance force for an exercise machine has been known in the prior art. However, the prior art resistance exercise devices suffer from many disadvantages, including being bulky in size, inconvenient to change resistance forces during operation when the user desires to quickly change the resistance force, and are frequently comprised of heavy metal blocks which require the user top go to the weight stack and change the resistance. Other machines have bands to change the resistance. There is a significant need to provide a new type of mechanical resistance apparatus which is compact in size, is light weight and provides an easy way for a user to select a desired resistance force during an exercise routine.

SUMMARY OF THE INVENTION

The present invention is an integrated resistance spring force assembly machine which is incorporated into an exercise machine. The integrated spring force assembly is comprised of a plurality of internal transverse sections with each section having a respective constant force spring to output a respective magnitude of a spring resistance force, which serves as the respective force loads when in use, and a force selection mechanism which can be used to selectively activate the respective springs so that the respective force loads can be output to a combined level of resistance for an exercise routine.

Each of the internal transverse sections has an identical structural configuration, comprising a central pulley connected to first and second identical flat constant force springs which are respectively connected to respective first and second side pulleys, wherein the position of the first spring is symmetrical to the position of the second spring relative to a center of the central pulley. Therefore, the first and second springs will expand and each will apply an identical constant force to the central pulley if the central pulley is in rotation. In addition, each central pulley is comprised of a central opening having first and second longitudinal grooves which are positioned around an interior surface of the opening and are positioned 180 degrees apart from each other.

The force selection mechanism is comprised of a plurality of cams positioned in a given relationship to the respective central pulleys, wherein each cam is a cylindrical structure comprising a central square opening and an exterior cylindrical surface. A plurality of pockets are positioned around the respective upper and lower circumferences of the exterior surface of each cam. The pockets are located along an upper circumference and are positioned to be symmetrical with the pockets located along the lower circumference. The pockets are positioned at selected locations relative to the center of each respective cam. In addition, upper and lower ball bearings which are movably positioned along the respective upper and lower circumferences of each cam relative to each pocket serve to engage a given pocket. The respective ball bearings will move in and out of the pockets if each cam is in rotation to thereby cause a cam to be engaged or disengaged. Only one-half of a ball bearing is in a pocket and the other half is in a drive shaft if a force resistance pulley is disengaged. One-half of a ball bearing is in a drive shaft and the other half is engaged to a central pulley if the force resistance pulley is engaged.

The mechanism is further comprised of an elongated force selection square shaft that penetrates through the central openings of the respective cams, a cylindrical pipe (or drive shaft) that serves as a housing for the cams incorporated within the shaft and the respective ball bearings, and a top force selection knob which is mated with a top collar.

The cylindrical pipe (or drive shaft) is comprised of first and second longitudinal sets of transverse openings on the cylindrical wall which are positioned to be 180 degrees apart from each other. In addition, the transverse openings of the first longitudinal set are positioned to match the upper circumferences of the respective cams after the cams that are penetrated by the square shaft are positioned inside of the pipe. The respective pockets in the cam are aligned with the respective openings in the drive shaft. Therefore, half of the ball bearings of the respective cams will be pushed into the respective transverse openings of the cylindrical pipe housing when they are pushed by the respective sections of the exterior surface of the respective cams.

Specifically, one half of each ball bearing is positioned inside of the transverse opening of the housing, and another half of each ball bearing is positioned inside of the groove of the central pulley after the cylindrical pipe is inserted into the central openings of the respective central pulleys. Therefore, the ball bearing that is simultaneously positioned in the groove of the central pulley and the opening of the housing locks the central pulley and housing to thereby transfer a force of a given resistance associated with that section to the central pulley, wherein the force is specifically applied to an exterior force outputting pulley that is connected to an exterior end of the housing. In this setting, the force rotates the central pulley to thereby expand the first and second flat constant springs. Therefore, the expanded springs provide forces to the central pulley which serve as the force loads generated by the integrated resistance spring force assembly.

The top force selection knob and its mating top collar are designed for rotatably selecting one or more cams to be engaged to the respective central pulleys so that variable magnitudes of the spring forces can be selected for use.

Therefore, it is an object of the present invention to provide an integrated spring force assembly machine to provide resistance forces to an exercise machine. The machine is comprised of a plurality of internal transverse sections having respective constant force springs to provide the respective magnitudes of the spring resistance force associated with each section. The internal transverse sections serve as the respective force loads of the resistance transferred to the exercise machine. A force selection mechanism can be used to selectively activate the respective springs so that the respective force loads can be output and provide the desired total level of resistance during an exercise routine.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIGS. 6*a* through 6*f* are a series of drawings that illustrate the respective structural characteristics of the upper series of pockets and sections of the exterior sides of the respective cams, wherein the drawings are illustrated in sub-FIGS. 6*a* through 6*f* which are taken along transverse cross-sections of the respective cams, which are cross-sections of the respective upper series of the structure of the respective cams;

FIG. 7 is a perspective view of a top cam of the force selection mechanism;

FIG. 9 specifically illustrates that the force selection mechanism is in operation after connection to the internal structure which creates the spring force load.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
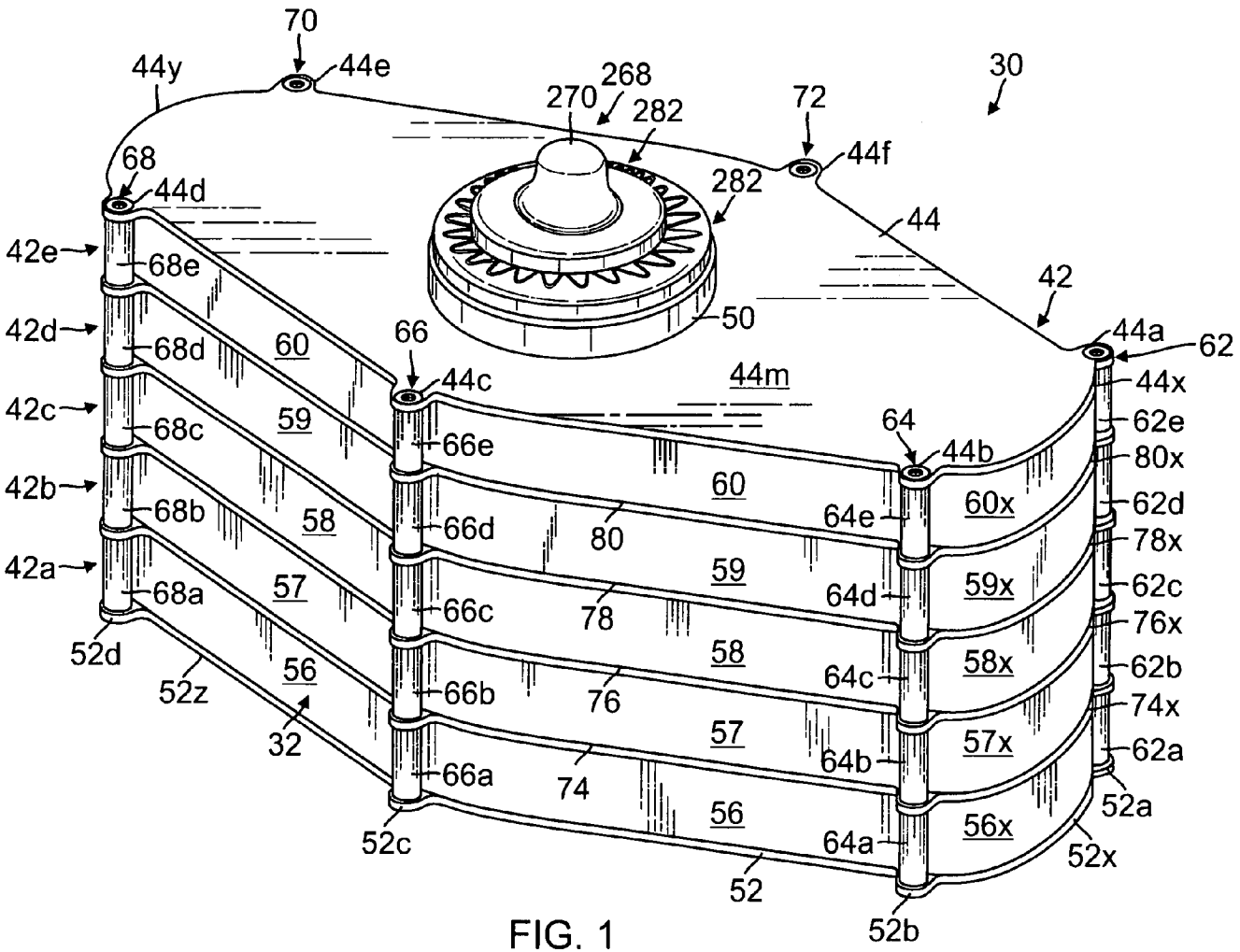
FIG. 1 is a perspective view of a preferred embodiment of the present invention integrated spring force assembly which provides resistance forces to be used with an exercise device.
Figure 8:
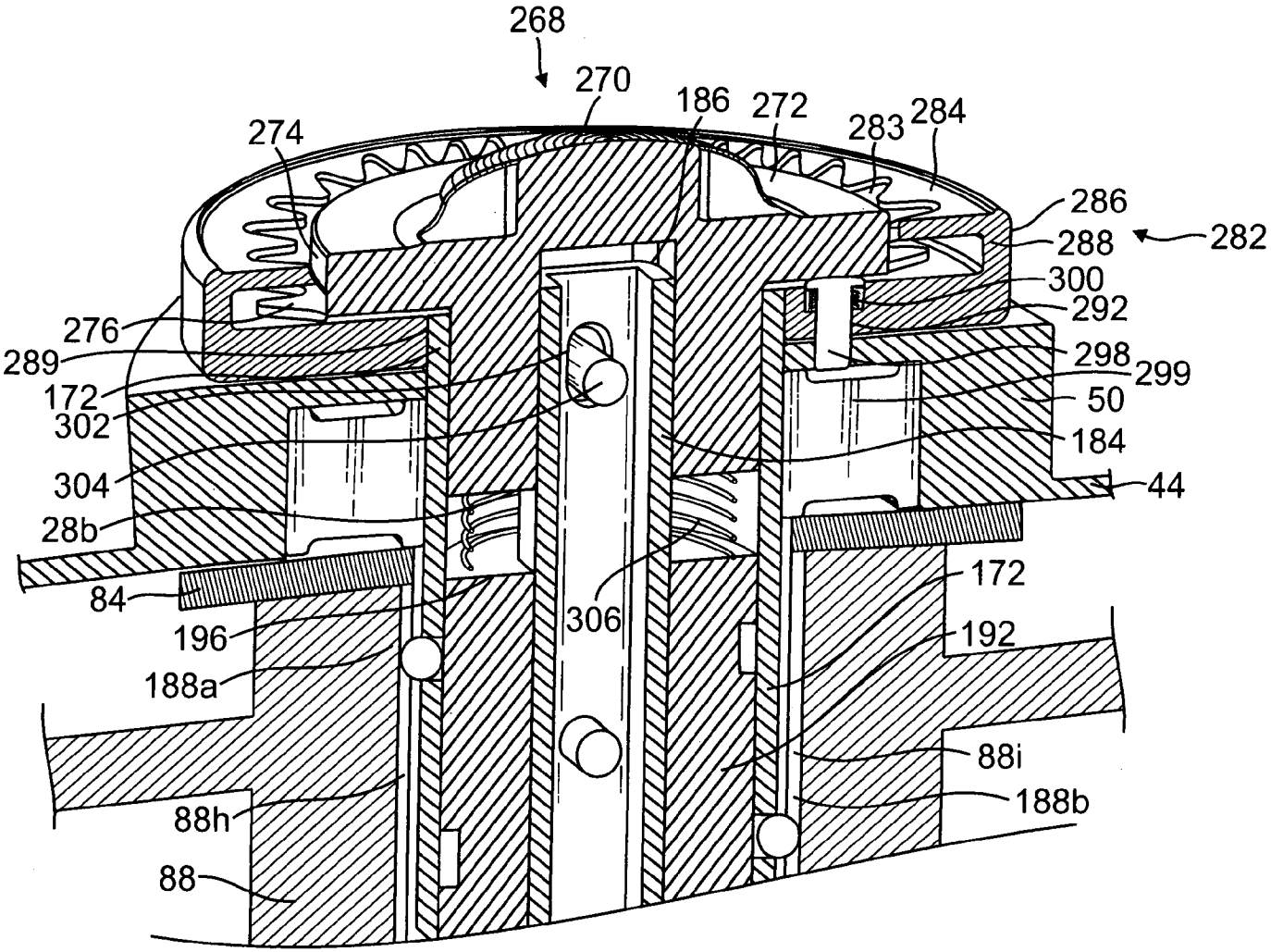
FIG. 8 is a longitudinal cross-sectional and elevational view of the present invention integrated spring force assembly, which specifically illustrates a position of a top force selection knob of the force selection mechanism in the process of selecting a specific magnitude of the spring force load provided by the internal structure.
Figure 9:
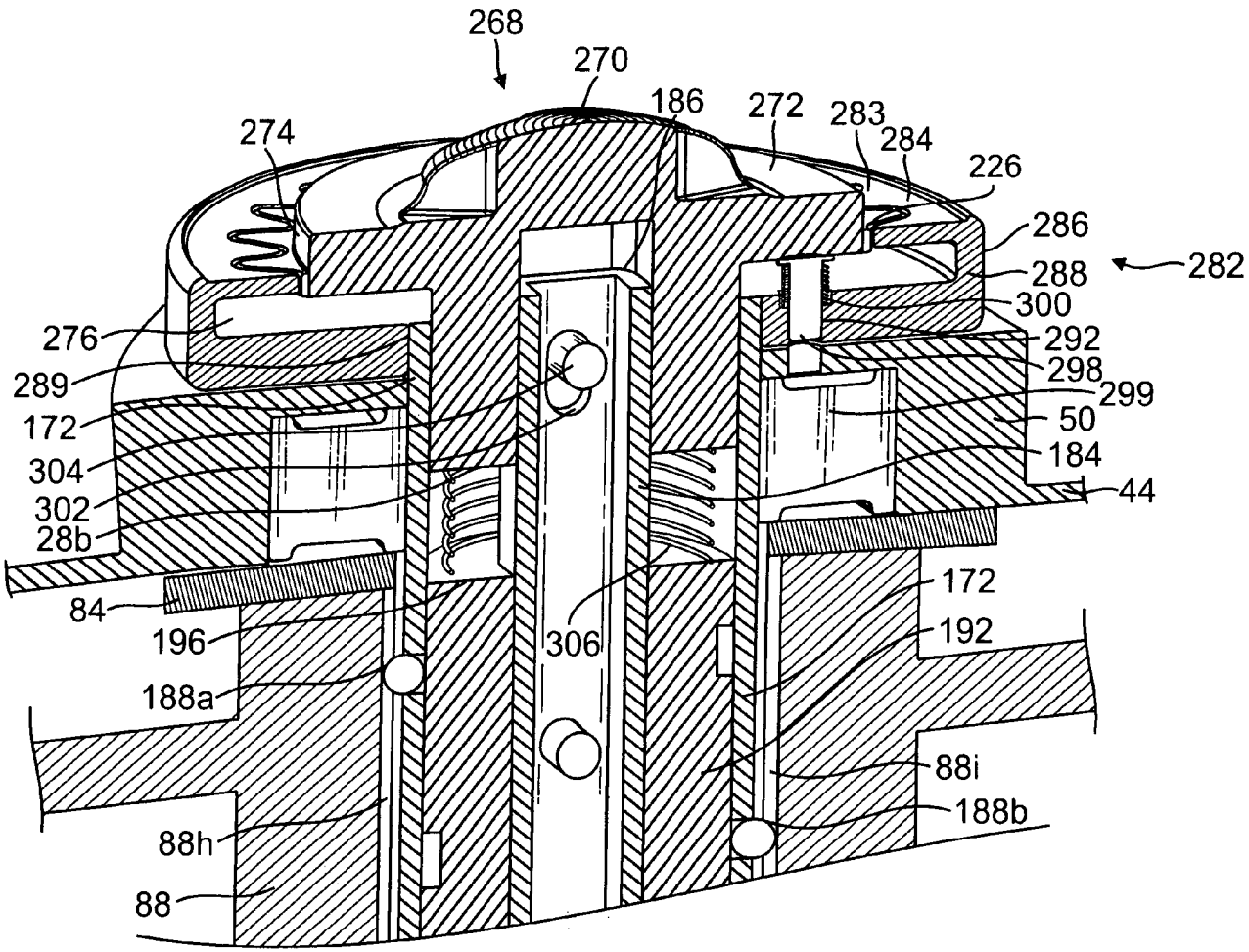
FIG. 9 is a longitudinal cross sectional and elevational view as compared with the view of FIG. 8.

Referring to FIGS. 1-10, there is illustrated the present invention integrated spring force assembly 30 which enables a user to select a desired resistance force from various magnitudes of spring forces by engaging a desired number of resistance members with a selected resistance provided by each member. The assembly 30 is comprised of an exterior housing 32 as illustrated in FIG. 1, an interior structure 34 which creates a spring force load as illustrated in FIGS. 2A-2C and 3A-3B, and a variable force selection mechanism 36 including a selected force outputting pulley 164 as illustrated in FIGS. 4 to 10 (in particular, FIG. 5), wherein FIGS. 8 and 9 illustrate how the force selection mechanism 36 is used to select a specific magnitude of resistance force after it is engaged to the internal structure 34.

Referring to FIGS. 1 and 2A-2C, the housing 32 of the assembly 30 is comprised of an outer longitudinal enclosed wall 42 and top and bottom transverse oval shaped covers 44 and 52, wherein the wall 42 further includes a plurality of longitudinal support posts 62, 64, 66, 68, 70 and 72 and a plurality of identical transverse support beams 74, 76, 78 and 80.

The transverse support beams are identical. By way of example, the transverse support beam 74 is a transverse frame structure preferably in the general shape of an oval. It includes a circumferential side wall 74*z* of the beam having a first proximal end 74*x* and a second distal end 74*y*. In a preferred embodiment, the wall has a short height. Six transverse extensions 74*a*, 74*b*, 74*c*, 74*d*, 74*e* and 74*f* having the respective central openings are positioned to extend outwardly on the exterior of the wall 74*z*, which are symmetrical relative to the longer symmetrical axis, the shorter symmetrical axis and the center of the As illustrated in FIG. 2B, a first transverse interior plate 74*g* is affixed to an interior side of the wall 74*z* adjacent the first proximal end 74*x* and the transverse extensions 74*a* and 74*b*. Within the plate, there is an opening 74*h* positioned adjacent an interior side of the plate 74*g*. Symmetrically, a second interior transverse plate 74*i* having an opening 74*j* is connected to the interior side of the wall adjacent the distal end 74*y* and the extensions 74*d* and 74*e*. The distal and proximal ends 74*y* and 74*x*, and the openings 74*j* and 74*h* are aligned with the longer symmetrical axis of the oval, and are further symmetrical to the center of the oval shaped beam 74.

It will be appreciated that the openings 74*j* and 74*h* are designed to lock the respective first and second interior axles that penetrate through the respective side pulleys of the assembly 30. It will be further appreciated that there are preferred grooves positioned at the respective top and bottom sides of the wall 74*z* so that the assembly outer wall 42 can be perfectly assembled.

Referring to FIG. 2B again, there is an illustrated inward transverse extension 74*k*, which is affixed to the interior side of the wall 74*z*. The extension is further positioned opposite to the outward extension 74*f*, and is further aligned with the shorter symmetrical axis that penetrates through the outward extensions 74*f* and 74*c*. The interior 74*aa* is hollow.

Figure 2A:
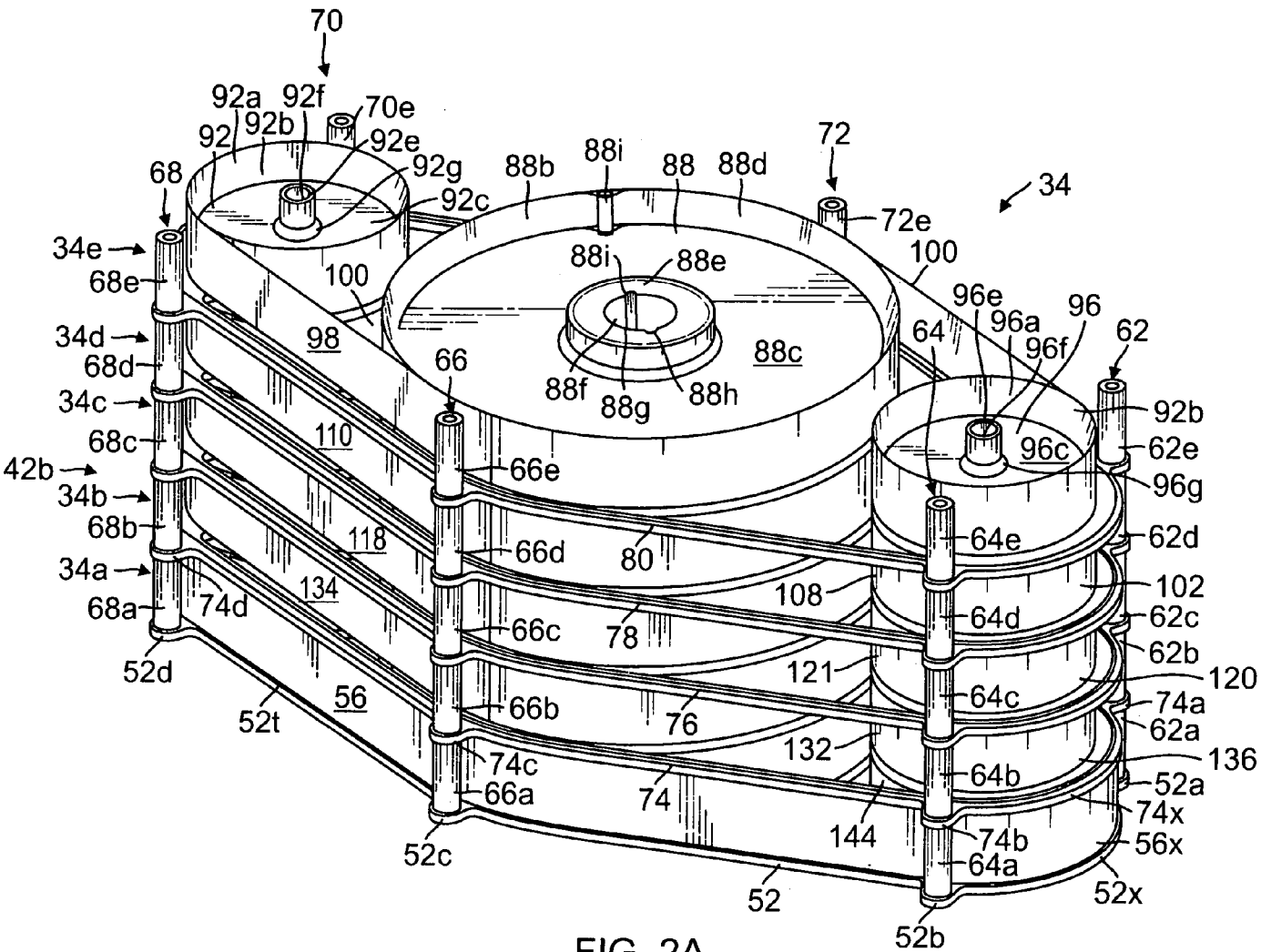
FIG. 2A is a perspective view of an internal structure of the integrated spring force assembly illustrating the internal structure which is comprised of five transverse sections, each of which includes a central pulley connected to two side pulleys through respective flat constant force springs associated with each of the three pulleys in each given section.
Figure 2B:
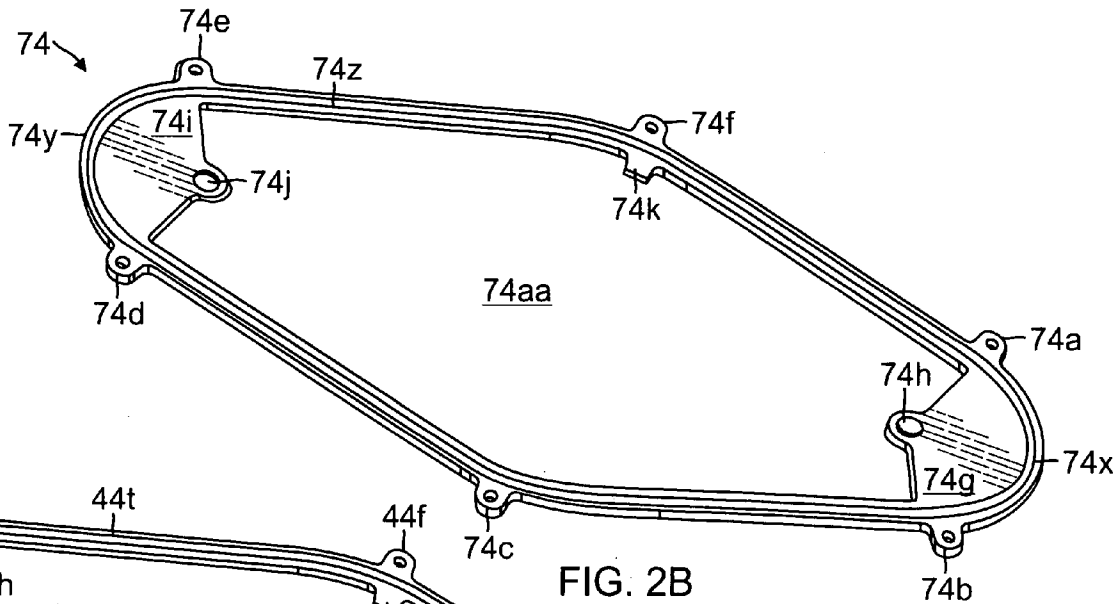
FIG. 2B is a perspective view of a transverse beam of the integrated spring force assembly.
Figure 2C:
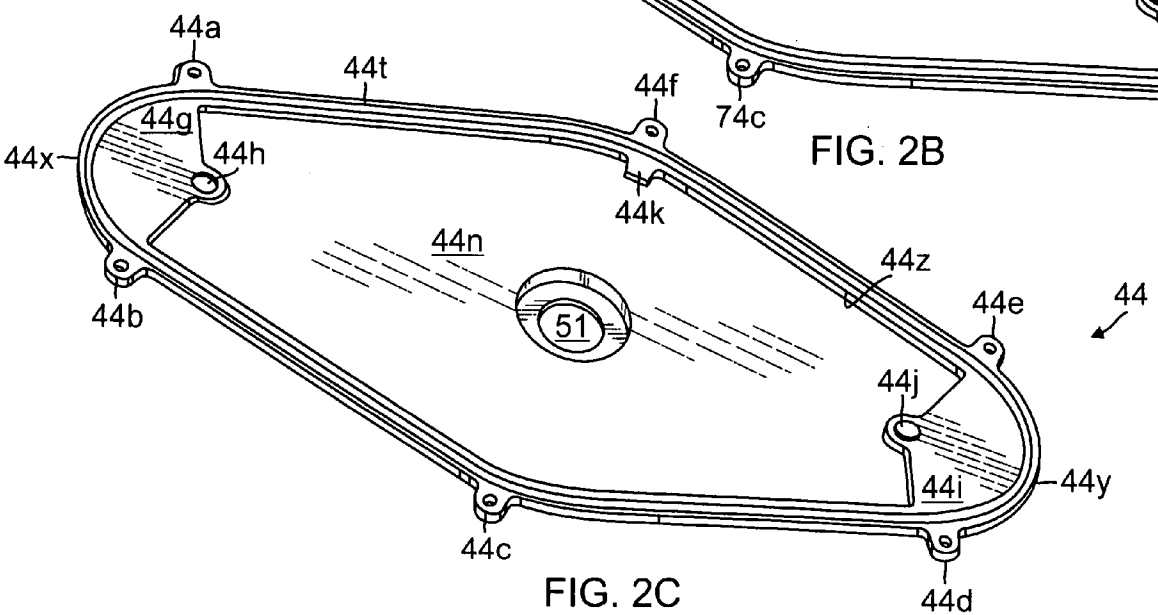
FIG. 2C is a perspective view of a top cover of the integrated spring force assembly, wherein the view is taken from the inner side of the cover.

Referring to FIGS. 1 and 2C, the top cover 44 is also preferably in the general shape of an oval which is similar in shape to the beam 74. The cover includes a first proximal end 44*x*, a second distal end 44*y* and a central circular upward extension 50 having a central opening 51 on the top surface 44*m* which are aligned along the longer symmetric axis of the oval shaped top cover 44. In addition, a shorter symmetrical axis of the oval shaped top cover is transverse to the first longer symmetrical axis and is also aligned with the central upward extension 50. There are six transverse outwardly extending extensions 44*a*, 44*b*, 44*c*, 44*d*, 44*e* and 44*f* of the top cover which are positioned along selected spaced apart circumferential locations and symmetrical to the two axes. Each of the extensions contains a central opening.

As specifically illustrated in FIGS. 2B and 2C, the top cover 44 has the same transverse dimensions as the beam 74. However, as compared with the beam 74 as the hollow frame, the top cover 44 comprises the structure of a sealed cap having exterior and interior sides 44*m* and 44*n* and the circumferential side wall 44*z*, wherein a groove 44*t* is positioned on the bottom side of the side wall 44*z*. As illustrated, a first interior downward extension 44*g* having an indentation 44*h*, which extend from the interior side 44*n*, is positioned adjacent the proximal end 44*x* and outward extensions 44*a* and 44*b*. Similarly, a second interior downward extension 44*i* having an indentation 44*j* is positioned adjacent the distal end 44*y* and the outer extension 44*d* and 44*e*. The proximal end 44*x*, the distal end 44*y*, the indentation 44*h* and the indentation 44*j* are aligned with the longer symmetrical axis, and are further symmetrical to the central opening 51. It will be appreciated that these two features of the indentation 44*h* and 44*j* are designed to locate the top ends of the respective first and second axles.

In addition, an additional inward and downward extension 44*k* is positioned to connect to the side wall 44*z*, which is opposite to the outward extension 44*f*, wherein the outward extensions 44*f* and 44*c* and the downward extension 44*k* are aligned with the short symmetrical axis of the top cover 44.

Referring to FIG. 1, the bottom cover 52 which has the same oval shape and the same dimensions as the top cover 44 is also a sealed cap having a circumferential side wall 52*z*, wherein there is a groove on the top side of the side wall. The bottom cover is further comprised of a first proximal end 52*x*, a second distal end (opposite end not shown) and a central opening, which are all aligned with a longer symmetric axis of the oval shaped bottom cover. In addition, a shorter symmetrical axis is transverse to the first longer symmetrical axis and is further aligned with the oval center. Along the circumferential wall 52*z* of the bottom cover there are positioned six transverse extensions symmetrical to the two axes, including four, 52*a*, 52*b*, 52*c* and 52*d*, that are visible in the figure. It will be appreciated that the bottom cover also includes a first interior indentation, a second interior indentation, and an inward interior extension, which are identical to those of the top cover 44.

In the preferred embodiment, the housing 32 is an assembly comprising five transverse sections 42*a*, 42*b*, 42*c*, 42*d* and 42*e*, each having a respective identical sectional enclosed wall 56, 57, 58, 59 and 60, identical longitudinal support posts 62, 64, 66, 68, 70 and 72, and identical transverse support beams 74, 76, 78 and 80.

As illustrated in FIGS. 1 and 2, the first section 42*a* which is the bottom section of the housing 32 is comprised of the upward sectional enclosed wall 56, six identical sectional longitudinal support posts including the first four 62*a*, 64*a*, 66*a* and 68*a* that are visible in the figure, and the bottom oval shaped cover 52. These six sectional longitudinal support posts are preferably cylindrical in shape. Each of the identical cylindrical support posts includes respective interior threaded holes positioned at the respective upper and lower ends. Therefore, five support posts 62*a*, 62*b*, 62*c*, 62*d* and 62*e* can be assembled together to thereby form the longitudinal support post series 62. The upward sectional enclosed wall 56 is also oval in shape having a proximal end 56*x* and distal end. In assembling of the wall, the ends are aligned with the respective proximal end 52*x* and distal ends (opposite end not shown) of the bottom cover 52, wherein a bottom end of the enclosed wall 56 is positioned inside of the groove of the side wall 52 of the bottom cover.

Referring further to FIG. 2, there is illustrated the second section 42*b* of the housing which is positioned to rest on the top of the first section 42*a*. The second section is comprised of the transverse enclosed support beam 74, six identical longitudinal support posts including the first four 62*b*, 64*b*, 66*b*, and 68*b* that are visible in the figure, and a sectional enclosed wall 57 (see FIG. 1).

As illustrated, the sectional enclosed wall 57 is identical to the sectional enclosed wall 56, comprising a proximal oval end 57*x* and a distal oval end (not shown). The transverse enclosed support beam 74 has the same transverse dimensions as the bottom cover. In addition, six identical outward extensions of which four—74*a*, 74*b*, 74*c* and 74*d*—are shown positioned identically to the respective six identical outward extensions of the respective top and bottom covers 44 and 52.

Therefore, it will be appreciated that after assembling the first (bottom) and second sections 42*a* and 42*b* of the housing 32, the sectional wall 56 of the bottom section can be fastened, wherein the top and bottom sides of the wall 56 are positioned inside of the respective grooves on the respective circumferential sides walls 74*z* of the beam 74 and sidewall (comparable to 44*z*) of the bottom cover 52, and all six longitudinal sectional support posts are threadedly connected between the respective extensions of the respective transverse bottom cover 52 and second transverse support 74. For example, the upward sectional support posts 64*a* are affixed by the extensions 52*b* and 74*b* after the oval shaped bottom cover 52 and transverse support beam 74 are positioned to be aligned with each other, wherein their respective proximal ends 52*x* and 74*x* and their respective distal ends are aligned with each other. Similarly, the six upward support posts are affixed by the respective paired extensions, wherein four pairs 52*a* and 74*a*, 52*b* and 74*b*, 52*c* and 74*c*, and 52*d* and 74*d* are visible in FIG. 2A.

In accordance with the above disclosed assembly procedure, it will be appreciated that all five sections 42*a*, 42*b*, 42*c*, 42*d* and 42*e* are fastened to form the housing 32. The order of fastening or engagement is provided wherein the bottom transverse cover 52 is connected to the first (bottom) upward sectional wall 56 which is connected to the second transverse support beam 74, which in turn is connected to the second upward sectional wall 57 connected to a third transverse support beam 76, which in turn is connected to a third upward sectional wall 58 connected to a fourth transverse support beam 78, which is connected to a fourth upward sectional wall 59 connected to a fifth transverse support beam 80, which in turn is connected to a fifth upward sectional wall 60 connected to the top cover 44. In summary, the exterior housing 32 includes a set of the upward sectional walls 56, 57, 58, 59 and 60, which are aligned together, wherein their proximal ends 56*x*, 57*x*, 58*x*, 59*x* and 60*x* are aligned together and also further aligned with the proximal ends 52*x*, 74*x*, 76*x*, 78*x*, 80*x* and 44*x* of the respective bottom cover 52, transverse support beams 74, 76, 78 and 80, and top cover 44.

In this arrangement, the first series 62 of the fastened longitudinal sectional support posts 62*a*, 62*b*, 62*c*, 62*d*, and 62*e* are aligned together. Similarly, the remaining five series of the longitudinal support posts are fastened to be aligned together, including the series 64 of 64*a*, 64*b*, 64*c*, 64*d* and 64*e*, the series 66 of 66*a*, 66*b*, 66*c*, 66*d*, and 66*e*, and the series 68 of 68*a*, 68*b*, 68*c*, 68*d* and 68*e* which are visible in FIG. 2. After alignment, they are fastened together with securing bolts (not shown). In addition, the top longitudinal sectional support posts 70*e* and 72*e* of the respective sets 70 and 72 are also visible in FIG. 2.

Referring to FIGS. 2A-2C and 3A, there is the illustrated internal structure 34, which is comprised of five transverse sections from a bottom to top sections 34*a*, 34*b*, 34*c*, 34*d* and 34*e* that are assembled together, wherein each section creates a spring force load if it is engaged. It will be appreciated that each section is identical in the structural configuration including a central pulley connected to a respective first and second side pulleys. The connection is by a respective first and second constant force spring. However, the only difference is that each of the paired springs is designed to have a different force magnitude when it is engaged to resist expansion.

Figure 3A:
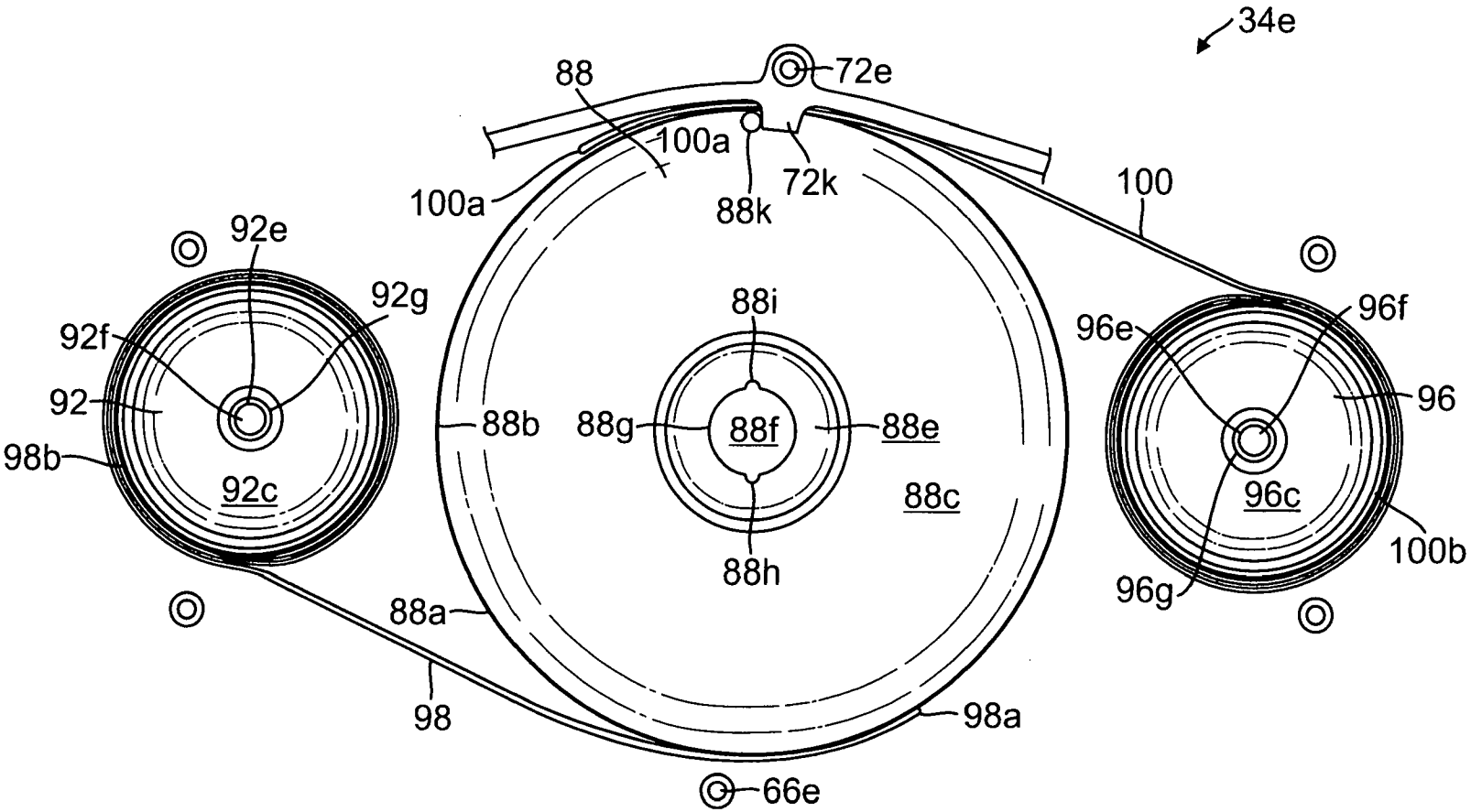
FIG. 3A is a top transverse sectional view of the internal three pulleys in each given section of the integrated spring force assembly, illustrating the respective flat constant force springs wrapped counter-clockwise around the central pulley when they expand.

As illustrated in FIGS. 2A and 3A, the top transverse section 34*e* is comprised of a central pulley 88 connected to the respective identical first and second side pulleys 92 and 96 through the respective first and second flat constant force springs 98 and 100.

The central pulley 88 includes an upward circumferential exterior wall 88*a* connected to a middle interior transverse round plate 88*c*, which forms an outer wall or rim 88*b* extending around the circumference of the plate 88*c* of the pulley. A longitudinal post 88*k* is positioned on the transverse plate 88*c* adjacent the rim 88*b*, wherein the post 88*k* has a height that is higher that the height of the rim 88*b*. In addition, the interior transverse plate 88*c* at the center is crossed by a cylindrical protruding extension 88*e* having a central opening 88*f* including an interior circular surface 88*g*. On the interior surface 88*g* there are located the first and second longitudinal grooves 88*h* and 88*i* which are positioned 180-degrees apart, and are aligned with a direction of the 12 and 6 o'clock position, wherein the outward extension 72*e* is placed adjacent the 12 o'clock position, and the extension 66*e* is adjacent the 6 o'clock position.

It will be appreciated that, as compared with the central pulley 88, the first and second side pulleys 92 and 96 have an identical structural configuration including the same thickness as the central pulley 88, except for a smaller pulley diameter. Therefore, the side pulleys 92 and 96 have the respective circumferential outer walls 92*a* and 96*a* connected to the respective middle interior transverse round plates 92*c* and 96*c*, which forms the respective outer rims 92*b* and 96*b* respectively extending around the circumference of the plates 92*c* and 96*c*. In addition, the interior transverse plates 92*c* and 96*c* at their respective centers are crossed by the respective cylindrical protruding hollow extensions 92*g* and 96*g* having the respective central openings 92*f* and 96*f*.

Referring again to FIGS. 2A and 3A, the first plate constant force spring 98 having first and second ends 98*a* and 98*b* is respectively affixed to the central pulley 88 and first side pulley 92. The second plate constant force spring 100 having first and second ends 100*a* and 100*b* is respectively affixed to the second side pulley 96 and central pulley 88. The plate constant force springs which are used in the present invention have a shape of a belt with the same constant outputting force when the springs are stretched. By way of example, the first and second constant force springs 98 and 100 may each have the same constant force of two and a half pounds.

As further illustrated, the first end 98*a* of the first spring 98 is affixed at approximately a 5 o'clock position of the exterior wall 88*a* of the central pulley 88. Symmetrically, the second end 100*a* of the second spring 100 is affixed at approximately an 11 o'clock position of the exterior wall 88*a* of the central pulley. To balance the clockwise force that is applied to the central pulley 88 by the first and second constant force springs 98 and 100, the longitudinal post 88*k* which is against a left side of the inward transverse extension 72*k* applies a counter-clockwise force to the central pulley. Therefore, the central pulley 88 is stationary before it is turned counter-clockwise by a user when engaged during an exercise routine.

The constant force springs 98 and 100 are pre-loaded so that the central pulley will be stationary against the stop 88*k* which rests against the extension (or stop dog) 72*k*. It will be appreciated that a driving force which is equal to twice the constant force of each spring is needed if it is desired to turn the central pulley 88 counter-clockwise to thereby expand the two springs. These two constant force springs 98 and 100 provide a fixed total force which, by way of example, can be 5 pounds to the central pulley 88 to cause such force to work against rotation of the pulley in the counter-clockwise rotation. It will be appreciated that the total force that is applied to the central pulley by the constant force springs serves as the resistance force during an exercise routine. In this situation, the longitudinal post 88*k* rotates as the central pulley 88 rotates in the counter-clockwise direction. The central pulley will stop its rotation when the post reaches a right side of the extension 72*k*. Therefore, the extension 72*k* serves as a stopper for the present invention.

Figure 3B:
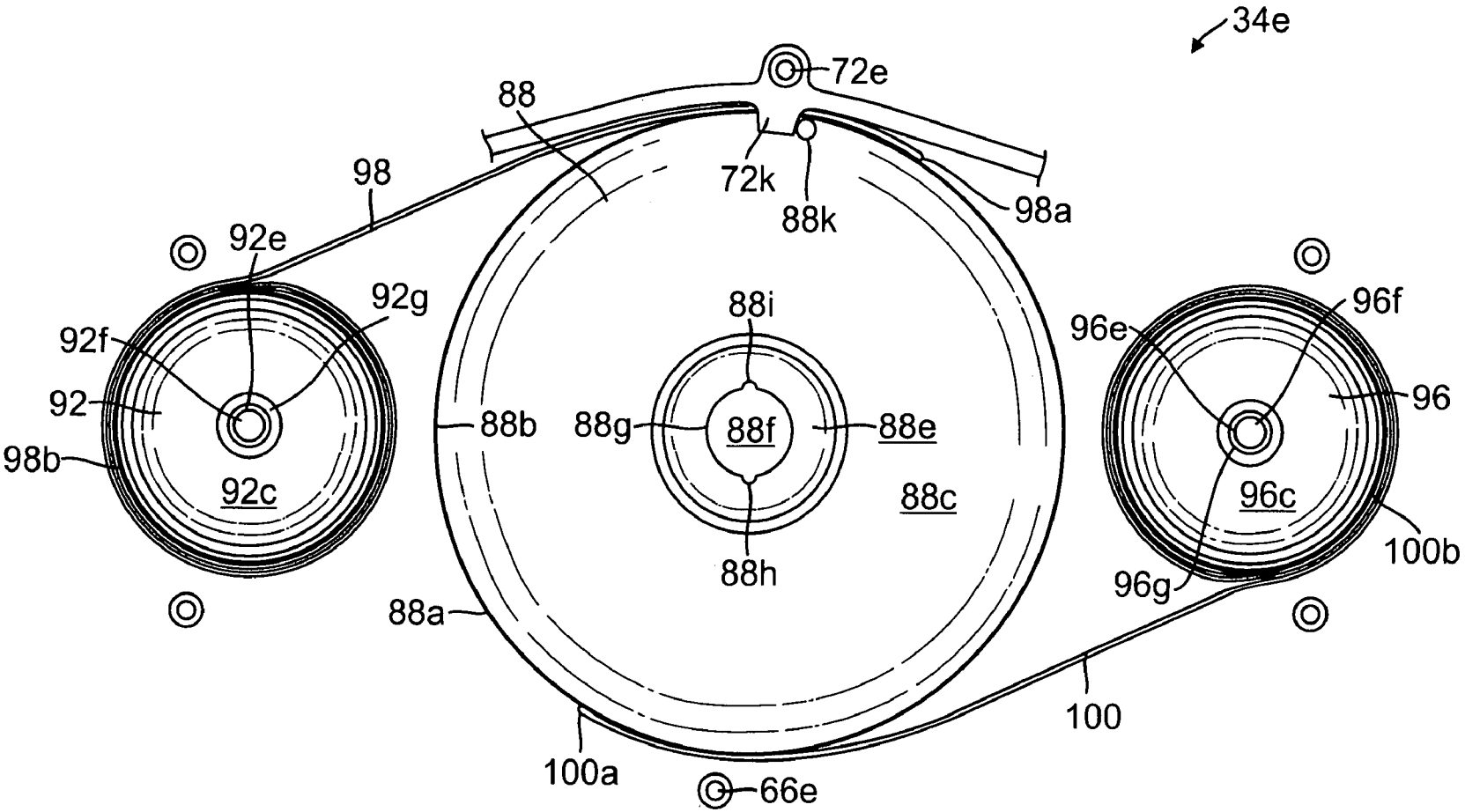
FIG. 3B is a top transverse sectional view of the internal three pulleys in each given section of the integrated spring force assembly, illustrating the respective flat constant force springs wrapped clockwise around the central pulley when they expand.

It will be further appreciated that in an alternative embodiment illustrated in FIG. 3B which is within the spirit and scope of the present invention, the central pulley 88 will provide the same resistance force of five pounds if it is rotated in the clockwise direction, where the first and second springs 98 and 100 that are connected to the central pulley 88 and the respective first and second side pulleys 92 and 96 are a mirror image of the first and second springs 98 and 100 that are illustrated in FIG. 3A but provide a counter-clockwise force. In addition, as illustrated in FIG. 3B, the longitudinal post 88*k* is against the right side of the extension 72*k* when the central pulley 88 is stationary. It will be appreciated that the central pulley stops rotation when the post is against the left side of the extension 72*k*.

Figure 5:
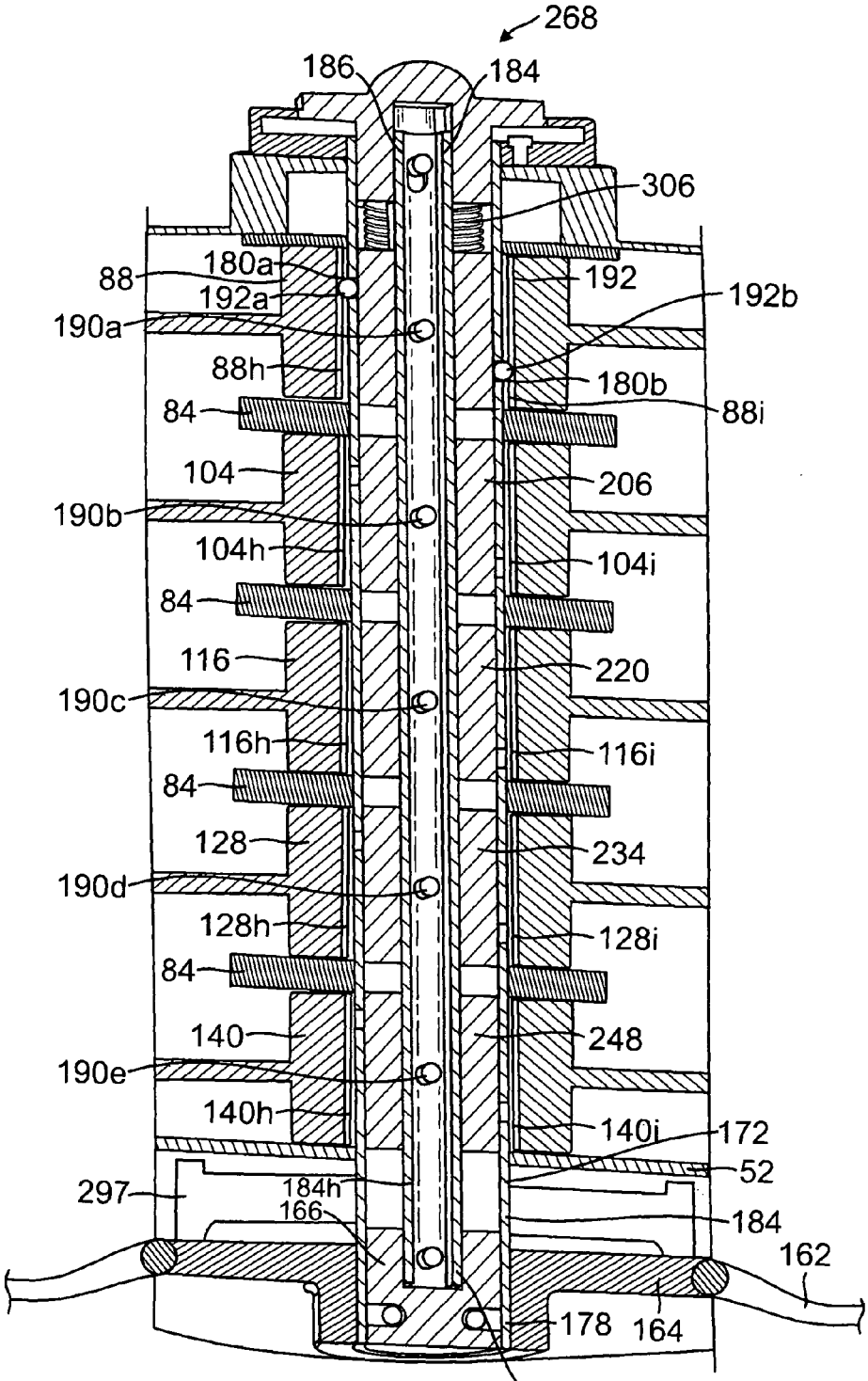
FIG. 5 is a longitudinal cross-sectional view of the present invention integrated spring force assembly, wherein the view specifically illustrates the structural configuration of the force selection mechanism that is combined with the internal structure to create a spring force load.

Following the above explanation, it will be appreciated that forces of different magnitude can be achieved by engaging two sets of constant force springs, wherein each of the constant force springs has a different constant force as compared with the output force of the respective springs 98 and 100 that are disclosed in FIG. 3A. Following this concept, as illustrated in FIGS. 2A and 5, the second section is constructed by connecting the second central pulley 104 to the respective first and second side pulleys through the respective first and second springs 110 and 112. The second central pulley 104 will provide a force of ten pounds when rotated in the counter-clockwise direction since each of the first and second constant force springs 110 and 112 outputs the same five pounds of the force when it expands.

Similarly, a third central pulley 116 in the third section 34*c* will provide a force of twenty pounds when rotated in the counter-clockwise direction since first and second constant force springs 118 and 120 output the same ten-pound resistance force against rotation. In the fourth section 34*b*, a fourth central pulley 128 will provide twenty-five pounds of the force when rotated in the counter-clockwise direction since the first and second constant force springs 134 and 136 output the same resistance force of twelve and a half pounds against rotation of the central pulley 128 in the counter-clockwise rotation. The fifth central pulley 140 will similarly provide a total resistance force of fifty pounds against rotation of the center pulley since the first and second constant force springs (not shown) output the same resistance force of twenty-five pounds. These are illustrative examples of force. It is within the spirit and scope of the present invention to provide many other sets of forces.

As illustrated in FIGS. 2A and 5, the interior structure 34 is assembled, wherein first longitudinal grooves 88*h*, 104*h*, 116*h*, 128*h* and 140*h*, and second longitudinal grooves 88*i*, 104*i*, 116*i*, 128*i* and 140*i* of the respective central pulleys 88, 104, 116, 128 and 140 are respectively aligned. In addition, the same size spacer 84 is positioned between each two adjacent central pulleys. Therefore, it will be appreciated that the user can select a different resistance load for a given exercise routine depending upon the number of the central pulleys that are engaged. It will be further appreciated that each of the interior transverse plates (corresponding to 74*i* and 74*g*) is also used as the spacer between two adjacent side pulleys. In addition, a first axle 92*e* is used to connect all first side pulleys such as 92, 106 and three lower pulleys. It penetrates through central holes of the respective side pulleys positioned adjacent the proximal end of the assembly, and the openings of the respective interior transverse plates of the beams, wherein its top and bottom ends are positioned inside of the interior indentation of the respective top and bottom covers 44 and 52. Similarly, a second axle 96*e* is used to connect to all second side pulleys 96, 108, 121, 132 and 144.

Figure 4:
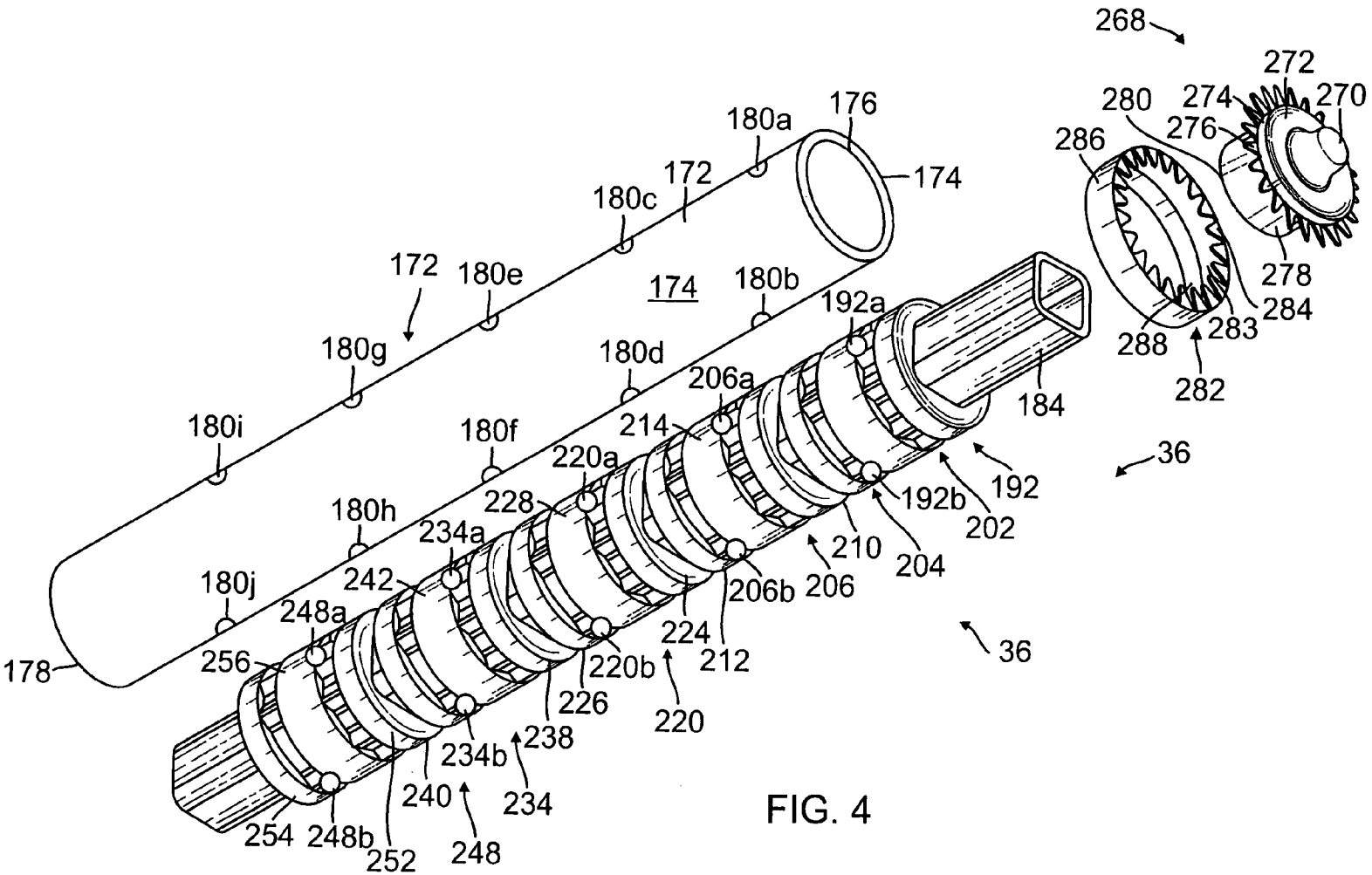
FIG. 4 is an exploded perspective view of a force selection mechanism of the present invention.

Referring now to FIGS. 4 and 5, there is illustrated the variable spring force selection mechanism 36 of the present invention. The mechanism 36 is comprised of five cams 192, 206, 220, 234, and 248, wherein each respective cam incorporates a respective pair of ball bearings 192*a* and 192*b*, 206*a* and 206*b*, 220*a* and 220*b*, 234*a* and 234*b*, and 248*a* and 248*b*. The mechanism also includes a hollow longitudinal square shaft 184 which functions as a square force selector, an exterior longitudinal cylindrical pipe (also known as a drive shaft) 172 which functions as the housing of the mechanism 36, and a top force selection knob 268 with a mating part top collar 282.

Referring to FIGS. 6A through 6*f*, there is illustrated a preferred embodiment of the first cam 192, comprising top and bottom transverse sides 196 and 198, a square opening 194 that longitudinally penetrates through the center of the cam, and an exterior cylindrical side 200. As illustrated in FIG. 7, there are upper and lower series of pockets positioned on the exterior cylindrical side 200, wherein the upper series is positioned on an upper circumference 202 adjacent the top side 196 of the cam, and the lower series is positioned on a lower circumference 204 adjacent the bottom side 198.

As disclosed, the first and second drawings 6*a* and 6*b* which are respectively labeled "5 # up" and "5 # low" are the respective transverse cross-sectional views of the respective upper and lower series of structural areas of the cams including the respective pockets and sections of the cam. The cross-sectional views are taken in alignment with the respective transverse upper and lower circumferences 202 and 204 of the cam 192. Referring to the drawing labeled as "5 # up", there is illustrated the upper series having various indentations 2*a*, 4*a*, 5*a*, 7*a*, 9*a*, 10*a*, 12*a*, 14*a*, 15*a*, 16*a*, 17*a*, 19*a*, and 21*a*, which represent the respective pockets positioned and aligned with the upper circumference 202 on the exterior cylindrical side 200. In contrast to the indentations, there are illustrated outward peaks (or plateau) 1*a*, 3*a*, 6*a*, 8*a*, 11*a*, 13*a*, 18*a*, 20*a* ans 22*a*, which represent the corresponding sections of the cam exterior surface 200. As further illustrated, each of the indentations is deep enough so that half of the upper ball bearing 192*a* will fall into it. In addition, as illustrated, there are a total of 22 structural features in the upper series.

It will be appreciated that half of the upper ball bearing 192*a* will move in and out of the indentations (or pockets) if it travels around the circumference 202. Alternatively, instead of the movement of the ball bearing 192*a*, if the cam 192 is rotated around a central axis of the central square hole 194, half of the upper ball bearing 192*a* will also move in and out of the indentations. It will be appreciated that such in and out movement of the ball bearing is a method by which a specific magnitude of the spring force is selected.

Referring to FIG. 7, there is illustrated a second set of pockets which are positioned along the lower circumference 204. The lower circumference 204 is positioned in parallel with and adjacent to the bottom transverse side 198. It will be appreciated that the lower (second) and upper (first) sets of the pockets are symmetrical relative to a center of the cam 192 which is illustrated in the second drawing 6*b* labeled as "5 # low". As illustrated, a plateau 1*a*' of the drawing 6*b* labeled "5 low" is 180-degrees apart from the plateau 1*a* of the drawing 6*a* "5 # up", and similarly an indentation 2*a*' of the drawing 6*b* "5 low" corresponds with the indentation 2*a* of the drawing 6*a* "5 # up". In fact, each indentation, or peak, or plateau of the drawing 6*b* "5 # low" which represents each of the pockets or sections of the cam exterior surface 200 that aligns with the cam lower circumference 204, is 180-degrees apart from the respective indentation, or peak, or plateau of the drawing 6*a* "5 # up". In addition, the lower series also includes a total of 22 structural features. Each respective plateau or indentation is correspondingly numbered with a prime after the letter.

Referring to the illustration of FIG. 4, the cylindrical pipe (or drive shaft) which functions as the housing 172 (or sleeve) is comprised of a cylindrical wall 174 having top and bottom ends 176 and 178, wherein an upper transverse opening 180*a* is positioned adjacent the top end 176 and penetrates through the cylindrical wall 174. The opening 180*a* is further aligned with a height of the upper circumference 202 of the first cam 192 that is positioned to surround the longitudinal square force selection shaft 184. Similarly, a lower transverse opening 180*b* which penetrates through the cylindrical wall 174 is positioned to align with the lower circumference 204 of the first cam 192, wherein the lower opening 180*b* is 180-degrees apart from the upper opening 180*a*.

Therefore, it will be appreciated that the upper and lower ball bearings 192*a* and 192*b* will have a synchronized outward or inward movement if the cam 192 rotates as the hollow square shaft 184 rotates around its longitudinal central axis, after the cam 192 and the ball bearings 192*a* and 192*b* are positioned inside of the cylindrical housing 172, wherein the upper and lower transverse openings 180*a* and 180*b* match the respective circumferences 202 and 204 of the cam 192. During the movement, half of the ball bearings 192*a* and 192*b* move inwardly to reside in one of the pockets when the respective openings 180*a* and 180*b* of the cylindrical housing 172 do not match one of the respective sections of the exterior side 200 of the cam 192. Half of the ball bearings 192*a* and 192*b* will move outwardly to reside in the respective transverse openings 180*a* and 180*b* of the housing if the openings of the cylindrical housing 172 match one of the respective sections of the exterior side 200 of the cam 192, for example, the respective plateau 1*a* and having top and bottom ends 176 and 178. The cylindrical drive shaft 172 acts as a bearing cage. The bearing is either halfway in the pipe and halfway in a pocket (disengaged) or halfway in the pipe wall and also halfway into the pulley (so it is engaged). A bearing never fully resides in a cam pocket.

It will be appreciated that the above illustration discloses the preferred embodiment of the cam 192 comprising the upper and lower sets of the structural features. However, it is within the spirit and scope of the present invention to only have one series of the pockets and peaks as an alternative embodiment for each cam of the present invention.

In reference to the structural characteristics and function of the first cam 192 that drives the ball bearings, it will be appreciated that the remaining five cams also have the respective upper and lower sets of the pocket structure with the same function to drive the respective ball bearings in movement. However, to simplify this disclosure of the structural features on each of the other cams, only the upper series of the structure including the pockets will be discussed. The structure of a lower series which is symmetrical to the structure of the upper series will not be discussed in detail.

As illustrated in FIGS. 4, 5 and 8, the second cam 206 is comprised of a central square hole 208 (see FIG. 6*c*) top and bottom transverse sides 210 and 212, an exterior cylindrical side 214, and upper and lower sets of pockets and sections of the exterior side 214.

Referring to a drawing 6*c* labeled as "10#" in FIG. 6, there is illustrated the structural components in the upper series of the second cam 208, which is positioned in parallel with and adjacent to the cam top transverse side 210. The upper series of the cam is comprised of a plurality of pockets 1*b*, 4*b*, 5*b*, 6*b*, 9*b*, 10*b*, 11*b*, 14*b*, 15*b*, 15*b*, 19*b* and 20*b*, and a plurality of the exterior side sections 2*b*, 3*b*, 7*b*, 8*b*, 12*b*, 13*b*, 16*b*, 17*b*, 18*b*, 21*b* and 22*b*. In addition, there is a corresponding second series of the pockets and peak areas which are symmetrical to the first series of the pockets and peak areas relative to the center of the second cam 206. It will be appreciated that the label "10#" indicates the second central pulley 104 has a load of 10 pounds during a counter-clockwise rotation.

If the first and second cams 192 and 206 are aligned together, wherein the plateau 1*a* of the first cam 192 is aligned with the pocket 1*b* of the second cam 206, and if the aligned first and second cams 192 and 206 are rotated synchronously, half of the ball bearing 192*a* of the first cam 192 will move outward when it contacts the plateau 1*a*. Oppositely, half of a ball bearing 206*a* of the second cam 206 will simultaneously move inward when it meets the pocket 1*b*. It will be appreciated that such different positions of the respective ball bearings cause different engagement combinations of cams and pulleys resulting in the respective different magnitudes of the spring resistance force for the user, which will be discussed in detail in a later section of the application.

Similarly, the third cam 220 is comprised of a central square hole 222 top (see FIG. 6*d*) and bottom transverse sides 224 and 226, an exterior cylindrical side 228, and upper and lower sets of pockets and sections of the exterior side. Referring to a drawing 6*d* labeled as "20#" in FIG. 6, there is illustrated components of an upper series, which is positioned in parallel with and adjacent to the cam top transverse side 224. The first series is comprised of a plurality of pockets 1*c*, 3*c*, 5*c*, 6*c*, 7*c*, 8*c*, 10*c*, 11*c*, 12*c*, 13*c*, 15*c*, 17*c* and 18*c*, and a plurality of the exterior side sections 4*c*, 9*c*, 14*c*, 16*c*, 19*c*, 20*c*, 21*c* and 22*c*. In addition, there is a corresponding second series of pockets and peak areas, which are symmetrical to the first series relative to the center of the second cam 220. Furthermore, the label "20#" means the third central pulley 116 will have a force load of 20 pounds during a counter-clockwise rotation.

The fourth cam 234 is comprised of a central square hole 236 top (see FIG. 6*e*) and bottom transverse sides 238 and 240, an exterior cylindrical side 242, and upper and lower sets of the respective pockets and sections of the exterior side. Referring to drawing 6*e* labeled as "25#" in FIG. 6, there is illustrated components of the upper series, which are positioned in parallel with and adjacent to the cam top transverse side 238. The upper series is comprised of a plurality of pockets 1*d*, 2*d*, 3*d*, 4*d*, 10*d*, 11*d*, 12*d*, 13*d*, 14*d*, 16*d* and 18*d*, and a plurality of the exterior side sections 5*d*, 6*d*, 7*d*, 8*d*, 9*d*, 15*d*, 17*d*, 19*d*, 20*d*, 21*d* and 22*d*. The label "25#" means the fourth central pulley 128 will have a force load of 25 pounds during a counter-clockwise rotation.

The fifth cam 248 is comprised of a central square hole 250 top (see FIG. 6*f* and bottom transverse sides 252 and 254, an exterior cylindrical side 256, and upper and lower sets of the respective pockets and sections of the exterior side. Referring to drawing 6*f* labeled as "50#" in FIG. 6, there is illustrated components of the upper series, which are positioned in parallel with and adjacent the cam top transverse side 252. The upper series is comprised of a plurality of pockets 1*e*, 2*e*, 3*e*, 4*e*, 5*e*, 6*e*, 7*e*, 8*e* and 9*e*, and a plurality of the exterior side sections 10*e*, 11*e*, 12*e*, 13*e*, 14*e*, 15*e*, 16*e*, 17*e*, 18*e*, 19*e*, 20*e*, 21*e* and 22*e*. In addition, the label "50#" means the fifth central pulley 140 will have a force load of 50 pounds during a counterclockwise rotation.

Referring to FIG. 4, there are illustrated the top force selection knob 268 and its mating part top collar 282. The knob 268 is comprised of a round head 270, a middle transverse round plate 272, and a bottom round member 278 which are all coaxially connected in series. As illustrated, the middle round transverse plate 272 at its exterior edge includes a circumference 274, wherein at a lower part of the circumference 274, the round plate 272 periodically extends outwardly to form a plurality of tooth members 276. In a preferred embodiment, there are a total of 22 tooth members. The bottom round member 278 has a bottom end 280 including a square interior opening, which matches the exterior side of the square force shaft 184.

The top collar 282 is comprised of transverse upper and lower ring members 284 and 288, wherein a cylindrical wall 286 connects to the respective exterior circumferences of the ring members. The upper ring member 284 further includes an interior circumference comprising a plurality of tooth receiving members 283, which match the respective tooth members 276 of the force selection knob 268. In a preferred embodiment, there are a total of 22 tooth receiving members.

Figure 10:
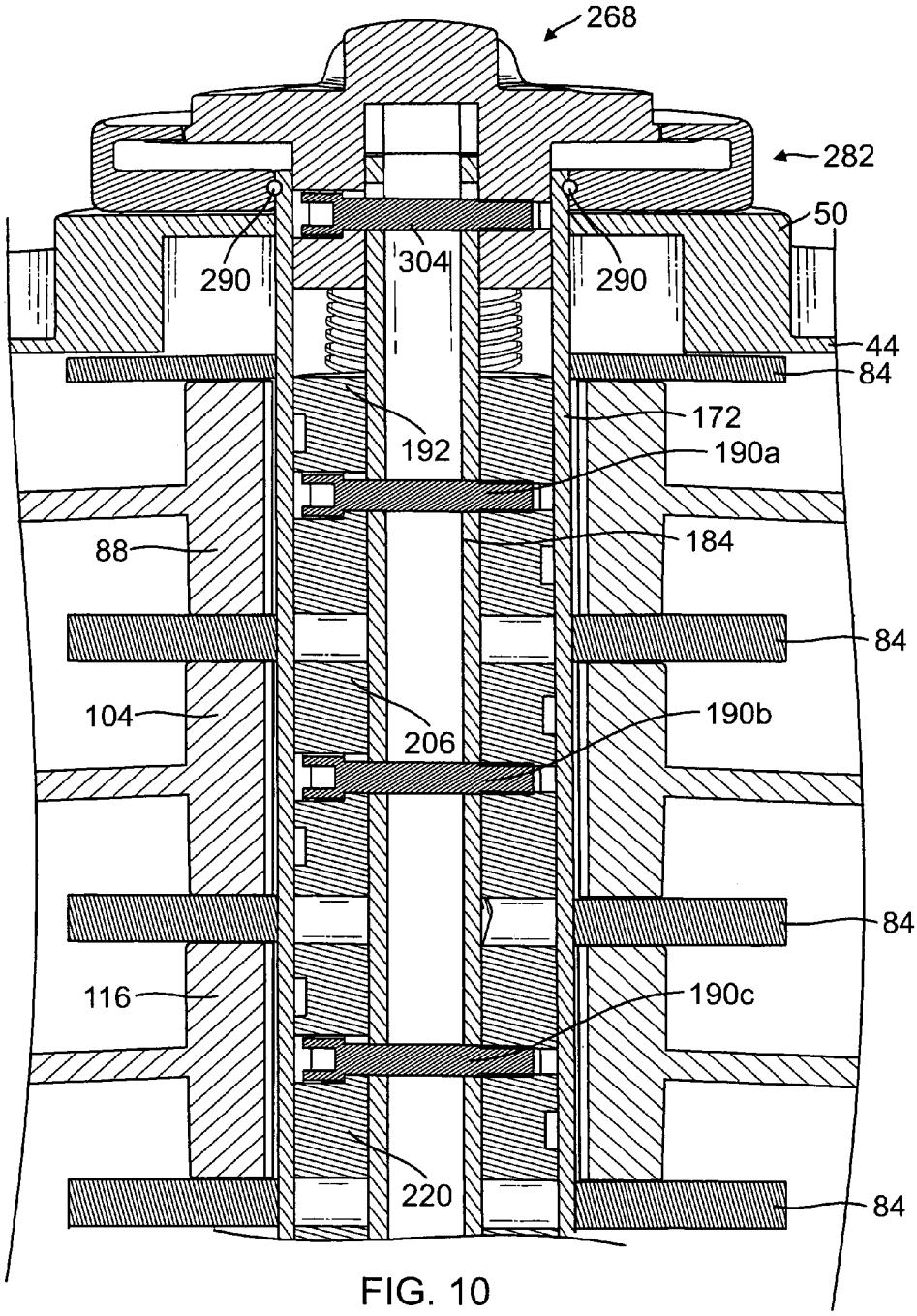
FIG. 10 is another longitudinal cross-sectional view of the present invention integrated spring force assembly, which is taken along a line which is 90 degrees relative to the cross-sectional view of FIG. 5.

As illustrated in FIGS. 8, 9 and 10, the lower transverse ring member 288 of the top collar 282 includes an interior circumference 289 that matches an exterior circumference of the cylindrical housing 172. Therefore, the housing top end 176 can be affixed to the lower ring member 288 through various methods including welding, or through mechanical affixation using a pair of transverse screws 290 as illustrated in FIG. 10. The transverse lower ring member 288 further comprises a longitudinal opening 292 adjacent to the interior circumference 289. It will be appreciated that the opening 292 is used to position a locking pin 298 for locking the lower ring member 288 of the top collar 282 to the top cover 44 during the process of selecting a specific force as a load of the spring resistance force during an exercise routine.

Referring to FIGS. 4, 5 and 6A-6F, there is illustrated the assembly of the force selection mechanism 36. The square shaft 184 penetrates through the central square openings 194, 208, 222, 236 and 250 of the respective cams 192, 206, 220, 234 and 248 when they are aligned together so that their respective pockets and exterior side sections have the same numerical numbers aligned together. As an example, illustrated in FIG. 6A the exterior side section 1*a* of the first cam 192 is aligned with the pocket 1*b* of the second cam 206 (FIG. 6C), the pocket 1*c* of the third cam 220 (FIG. 6D), the pocket 1*d* of the fourth cam 234 (FIG. 6E), and the pocket 1*e* of the fifth cam 248 (FIG. 6F). In addition, the respective paired ball bearings 192*a* and 192*b*, 206*a* and 206*b*, 220*a* and 220*b*, 234*a* and 234*b*, and 248*a* and 248*b* are positioned according to the respective upper and lower series of the structural components of the respective cams 192, 206, 220, 234, and 248.

As illustrated in FIGS. 5 and 10, after connection of the five cams to the square shaft, five transverse screws 190*a*, 190*b*, 190*c*, 190*d* and 190*e* penetrate through the respective cams 192, 206, 220, 234 and 248 to affix them to the central square force selector 184. Referring to FIG. 5 as compared with the illustration of FIG. 10, a direction of the screws connecting the cams and central square force selector is at 90-degrees to the plane that aligns with the transverse openings 180*a*, 180*b*, 180*i* and 180*j* of the cylindrical housing 172. In addition, as illustrated in FIG. 10, each screw penetrates through the middle of each cam, so that the structure of pockets is protected:

Therefore, the bottom round member 278 of the top force selection knob 268 extends through the central hole 51 of the top cover 44 to cover into the upper end 186 of the force selection shaft 184, after a spring 306 is placed to contact between the bottom side 280 of the knob and the top side 196 of the first cam 192. As illustrated in FIG. 9, there is a slot 302 positioned adjacent the top 186 of the shaft. Therefore, the top knob 268 is locked to the shaft 184 by using a transverse screw 304 that penetrates through the bottom member 278 of the knob and the slot 302 of the shaft.

In this setting, after installing the respective upper and lower positioned ball bearings for each cam, the exterior longitudinal cylindrical housing 172 is positioned to surround the five cams that are penetrated by the central square force selector 184. As illustrated in FIG. 4, the transverse openings 180*a*, 180*c*, 180*e*, 180*g* and 180*i*, as a first longitudinal set of openings of the housing 172, are transversely aligned with the respective upper sets having the pocket structure of the respective cams 192, 206, 220, 234 and 248. The transverse openings 180*b*, 180*d*, 180*f*, 180*h* and 180*j*, as a second longitudinal set of openings of the sleeve or housing 172, are transversely aligned with the respective lower sets having the pocket structure of the respective cams 192, 206, 220, 234 and 248. In addition, as illustrated in FIG. 5, the transverse openings 180*a*, 180*c*, 180*e*, 180*g* and 180*i* in the first longitudinal set are at 180-degrees apart from the transverse openings 180*b*, 180*d*, 180*f*, 180*h* and 180*j* in the second longitudinal set.

Referring again to FIGS. 1, 5, 8 and 9, there is illustrated that the top collar 282 is placed at the top of the central extension 50 of the top cover 44. In addition, the locking pin 298 is arranged so that a lower part of the pin is inserted into the opening 292 positioned on the collar lower ring member 288, and the pin upper head is supported by another spring 300. In this setting, the above illustrated housing 172 penetrated by the cams that surround the square shaft 184 having the top selection knob 268 is inserted to penetrate through a series of openings of components of the present invention assembly 30. They comprise the opening of the top collar, the central opening of the top cover, the openings of the respective internal central pulleys, and the opening of the bottom cover. Two roller bearings 297 and 299 on opposite ends of the housing 172 serve to keep the housing centered within the device. Lower roller bearing 297 is illustrated in FIG. 5. Upper roller bearing 299 is illustrated in FIGS. 8 and 9. During the insertion, the bottom end 188 of the square shaft 184 extends in a direction from the top placed collar 282 to the bottom cover 52. As further illustrated in FIG. 5 after completion of the insertion, the bottom end 178 of the cylindrical housing 172 is affixed into a center of an exterior force outputting pulley 164. Accordingly, the bottom end 188 of the square shaft 184 is affixed into a member 166, which is positioned inside of the housing 172 further adjacent the housing bottom end 178. In addition, the member 166, the housing bottom end 178 and a central part of the exterior force outputting pulley 164 are affixed together by screws.

It will be appreciated that, according to the situation wherein the locking pin 298 locks the lower ring member 288 of the collar, the interior grooves of the respective central pulleys are aligned with the direction of the 12-6 o'clock position, and the longitudinal posts of the respective central pulleys are against the left sides of the respective inward extensions, in accordance with the example as illustrated in FIG. 3A which illustrates the option of counter-clockwise activation of the central pulley 88.

Referring specifically to FIG. 9, there is illustrated that the spring 306 that is positioned between the force selection knob 268 and the top cam 192 pushes the knob up. Therefore, the locking pin 298 is also positioned up since it is moved by an upward force applied from the spring 300. The result of this is that the exterior tooth members 276 of the knob 268 and the interior tooth receiving members 283 of the top collar 282 mate together, so that the mated knob 268 and collar 282 enable rotation if the housing is rotatable.

In addition, it will be appreciated that according to the above illustrated cam alignment, only half of the upper and lower ball bearings 192*a* and 192*b* of the first cam 192 are pushed by the respective plateaus 1*a* and 1*a*' into the respective upper and lower openings 180*a* and 180*b* of the cylindrical housing 172 and the respective grooves 88*h* and 88*i* which function as internal engagement means or engagement mechanism. Referring to FIGS. 4, 5, 8 and 9, the ball bearing 192*a* is positioned so that one half of the ball bearing is inside of the transverse opening 180*a* and another half is inside of the groove 88*h* of the top central pulley 88. Similarly, the ball bearing 192*b* is positioned so that one half is inside of the transverse opening 180*b* and another half is inside of the groove 88*i* of the top central pulley 88. Therefore, the upper and lower ball bearings 192*a* and 192*b* serve as the respective locking members, which lock the top central pulley 88 to the force selection mechanism 152 including the housing 172.

It will be further appreciated that in this setting if a user during an exercise routine applies the body force of five pounds for rotating the exterior pulley 164 counter-clockwise through a force transferring means such as a cable 162 (see FIG. 5) that is connected to the exterior force outputting pulley, the body force will be applied to the top central pulley 88 through the rigid mechanical parts of the housing (or drive shaft) 172 affixed to the top selection knob 268, which is affixed to the square shaft 184, which is affixed to the first cam 192. However, since the cam is locked by the upper and lower ball bearings 192*a* and 192*b*, the user can exercise his/her body at a selected magnitude of the force such as five pounds, since the central pulley 88 creates a resistance force of five pounds from the first and second springs 98 and 100.

The illustrations in FIGS. 6*a* through 6*f* correspond to the following Table 1 which discloses all options, where one or more central pulleys in the interior spring force structure will be engaged through corresponding positions of the exterior side sections of the respective cams so that to lock a specific set of pulleys in a given cam, half of the ball bearings extend through respective openings in the housing 172 and half of the ball bearings extend into a respective groove in a respective central pulley so the ball bearing is one-half in an opening in the central housing (or drive shaft) 172 and one-half in a groove in a respective central pulley. Such options correspond to the respective magnitudes of the spring force for the user to choose for any desired exercise.

Referring to Table 1, there are illustrated positions labeled as "x" which indicate that the respective exterior side sections of the respective cams are positioned to align with the transverse openings of the housing 172. Therefore, half of the corresponding ball bearings are pushed to reside in the respective openings of the housing 172 and half of the corresponding ball bearing reside in the grooves of the respective central pulleys of the internal structure. This results in connection of the respective internal pulleys to the housing (or drive shaft) 172 of the force selection mechanism 36, so that the exterior pulleys are engaged to provide the corresponding magnitudes of the spring resistance forces when the corresponding constant force springs are expanded.

For example, if only the first (top) cam 192 is selected, the result is that the top interior central pulley 88 is engaged to thereby output the total force of 5 pounds to the exterior pulley 164. This is the resistance force encountered by the user during an exercise routine. As another example, if all five cams are selected, it results in all five central pulleys being engaged to output a total force of 110 pounds. It will be appreciated that other subsets of forces and total forces of any desired amount are within the spirit and scope of the present invention.

It will be appreciated that each tooth member of the force selection knob 268 is labeled by a number selected from 1 to 22, wherein the number corresponds to the position number listed in Table 1. This means that when one of the tooth members 276 is selected, the corresponding cam or cams will be engaged to thereby engage the corresponding central pulley or pulleys.

TABLE 1

Magnitudes of the spring force selected from selecting the cam positions
Selector Switch Range

| 1st Cam | 2nd Cam | 3rd Cam | 4th Cam | 5th Cam | Position | Force (Ib) |
|---|---|---|---|---|---|---|
| x | | | | | 1 | 5 |
| | x | | | | 2 | 10 |
| x | x | | | | 3 | 15 |
| | | x | | | 4 | 20 |
| | | | x | | 5 | 25 |
| x | | | x | | 6 | 30 |
| | x | | x | | 7 | 35 |
| x | x | | x | | 8 | 40 |
| | | x | x | | 9 | 45 |
| | | | | x | 10 | 50 |
| x | | | | x | 11 | 55 |
| | x | | | x | 12 | 60 |
| x | x | | | x | 13 | 65 |
| | | x | | x | 14 | 70 |
| | | | x | x | 15 | 75 |
| | x | x | | x | 16 | 80 |
| | x | | x | x | 17 | 85 |
| x | x | | x | x | 18 | 90 |
| | | x | x | x | 19 | 95 |
| x | | x | x | x | 20 | 100 |
| | x | x | x | x | 21 | 105 |
| x | x | x | x | x | 22 | 110 |

Referring to FIGS. 8 and 9, there is illustrated the process to select preferred magnitudes of the spring force by selecting the corresponding positions of the corresponding cams. As illustrated in FIG. 8, the user presses the force selection knob 268 down, so that the locking pin 298 moves down to lock the top collar 282 and top cover 44 together. Therefore, the user can turn the knob in any rotational direction to align a specific tooth member 276 of the knob 268 to a tooth receiving member 283 of the collar upper ring member 284 which serves as a reference point so that the specifically desired cam or cams can be selected. In this setting, since the housing is affixed to the top collar that is locked to the top cover 44, only the square shaft and the cams can rotate, which results in half of the corresponding ball bearings of the selected cams moving out to lock the corresponding central pulley or pulleys.

After selecting a desired magnitude of the resistance force, the top knob 268 is released to thereby mate with the upper transverse ring member 284 of the collar 282, which results in the tooth members 276 being positioned into the respective tooth receiving members 283. It will be appreciated that releasing the top knob 268 results in the release of the locking pin 298. Therefore, the housing (or drive shaft) 172 that is engaged by selected ball bearings to the corresponding central pulley or pulleys can transfer the selected magnitude of the spring force to the exterior pulley 164, which generates the resistance force provided to the user during an exercise.

It will be appreciated that the above only discloses the preferred embodiment of the present invention. However, various variations are readily available. For example, the illustrated five cams can be arranged to be an integrated one for easily manufacturing. In addition, as compared with the disclosed five sections of the transverse force load mechanisms, more or less the force load sections are also appropriate according to the spirit and scope of the present invention.

Defined in detail, the present invention is an integrated resistance spring force machine comprising: (a) a plurality of internal transverse sections with each section having a respective constant force spring to output a respective magnitude of a spring resistance force which serves as the respective force loads when in use, and a force selection mechanism which is used to selectively activate one or more respective constant force springs so that the respective force loads of the selected constant force springs can be output to a combined level of resistance; (b) each of the internal transverse sections has an identical structural configuration comprising a central pulley connected to first and second identical flat constant force springs which are respectively connected to respective first and second side pulleys, each central pulley having a pair of oppositely disposed internal grooves, wherein the position of the first spring is symmetric to the position of the second spring relative to a center of the central pulley so that the first and second springs will expand and each will apply an identical constant force to the central pulley if the central pulley is in rotation; (c) the force selection mechanism comprised of a plurality of cams positioned in a given relationship to the respective central pulleys, wherein each cam is a cylindrical structure comprising a central square opening and an exterior cylindrical surface with a plurality of alternating pockets and plateaus positioned around respective upper and lower circumferences of the exterior surface of each cam, respective upper and lower ball bearings which are movably received in the respective upper and lower circumferences of each cam so that half of the respective ball bearings will be either in or out of the pockets when its respective cam is rotated; (d) an elongated force selection square shaft that penetrates through the central openings of the respective cams, a cylindrical housing that surrounds the cams and serves as a housing for the cams, and a force selection knob which is mated with a collar and coordinated with the cams to cause the cams to rotate by a given turn when the force selection knob is rotated by a given rotational turn; and (e) the cylindrical housing comprised of first and second longitudinal sets of transverse longitudinally spaced apart openings on a cylindrical wall of the housing, wherein each opening from a first set is positioned 180 degrees apart from each opening in the second set, the respective transverse openings of the first longitudinal set are respectively positioned to match the upper circumferences of the respective cams and the transverse openings of the second longitudinal set are respectively positioned to match the lower circumferences of the respective cams so that some of the ball bearings of the respective cams will be aligned with a plateau of a cam and thereby half of such ball bearings will be pushed so that it rests partially in a respective transverse opening of the housing and partially in an internal groove of a central pulley, and half of some of the ball bearings will remain in a pocket of a cam and half of the ball bearings will remain in an opening of the housing if a plateau is not aligned with an opening in the housing whereby the engagement of a ball bearing in an opening of the housing and a corresponding internal groove of a central pulley causes a resistance force from the constant force springs associated with that cam to be engaged.

Defined broadly, the present invention is an integrated resistance spring force machine comprising: (a) a plurality of internal transverse sections with each section having a respective constant force spring to output a respective magnitude of a spring resistance force which serves as the respective force loads when in use, and a force selection mechanism which is used to selectively activate one or more respective constant force springs so that the respective force loads of the selected constant force springs can be output to a combined level of resistance; (b) each of the internal transverse sections has a structural configuration comprising a central pulley connected to first and second flat constant force springs which are respectively connected to respective first and second side pulleys so that the first and second springs will expand and each will apply a constant force to the central pulley if the central pulley is in rotation, each central pulley having a pair of spaced apart engagement mechanisms; (c) the force selection mechanism comprised of a plurality of cams positioned in a given relationship to the respective central pulleys, wherein each cam is comprised of a central opening and an exterior surface with a plurality of alternating pockets and plateaus positioned around respective upper and lower areas of the exterior surface of each cam, respective upper and lower ball bearings which are movably received in the respective upper and lower area of the exterior surface of each cam so that half of the respective ball bearings will be either in a pocket or out of a pocket and on a plateau when its respective cam is rotated; (d) an elongated force selection shaft that penetrates through the central openings of the respective cams, an external sleeve that surrounds the cams and serves as a housing for the cams, and a force selection knob which is coordinated with the cams to cause the cams to rotate by a given turn when the force selection knob is rotated by a given rotational turn; and (e) the sleeve comprised of first and second longitudinal sets of transverse longitudinally spaced apart openings on a wall of the sleeve, wherein each opening from a first set is positioned at a given distance apart from each opening in the second set, the respective transverse openings of the first longitudinal set are respectively positioned to match the upper surface areas of the respective cams on a respective engagement mechanism of a central pulley and the transverse openings of the second longitudinal set are respectively positioned to match the lower surface areas of the respective cams and a respective engagement mechanism of the central pulley so that half of selected of the ball bearings of the respective cams will be pushed from a plateau into the respective transverse openings of the sleeve and corresponding engagement mechanism of a central pulley, half of some of the ball bearings will remain in a pocket of a cam and half in a transverse opening of the sleeve if a plateau is not aligned with an opening in the sleeve whereby the engagement of a half of a ball bearing in an opening of a sleeve and half of a ball bearing in a corresponding engagement mechanism of a central pulley cause a resistance force from the constant force springs associated with that cam to be engaged.

Defined more broadly, the present invention is an integrated resistance spring force machine comprising: (a) a plurality of internal transverse sections with each section having a respective constant force spring to output a respective magnitude of a spring resistance force which serves as the respective force loads when in use, and a force selection mechanism which is used to selectively activate one or more respective constant force springs so that the respective force loads of the selected constant force springs can be output to a combined level of resistance; (b) each of the internal transverse sections has a structural configuration comprising a central pulley connected to at least one constant force spring which is connected to at least one side pulley so that the at least one spring will expand and will apply a constant force to the central pulley if the central pulley is in rotation; (c) the force selection mechanism comprised of a plurality of cams positioned in a given relationship to the respective central pulleys, wherein each cam is comprised of a central opening and an exterior surface with a plurality of pockets positioned around an area of the exterior surface of each cam, respective ball bearings which are movably received in the respective area of the exterior surface of each cam so that half of the respective ball bearings will be either in or out of the pockets when its respective cam is rotated; (d) an elongated force selection shaft that penetrates through the central openings of the respective cams, an external sleeve that surrounds the cams and serves as a housing for the cams, and a force selection knob which is coordinated with the cams causes the cams to rotate by a given turn when the force selection knob is rotated by a given rotational turn; and (e) the sleeve comprised of at least one set of transverse longitudinally spaced apart openings on a wall of the sleeve, the respective transverse openings are respectively positioned to match the exterior surface area containing pockets of each respective cam so that half of some of the ball bearings of the respective cams will be pushed into the respective transverse openings of the sleeve and each central pulley having at least one engagement mechanism which receives half of a ball bearing if it is pushed out of a pocket and into an opening in the sleeve, whereby the engagement of half of a ball bearing in an opening of a sleeve and half of a ball bearing pushed into the engagement mechanism of a central pulley causes a resistance force from the at least one constant force spring associated with that cam to be engaged, and some of half of the ball bearings will remain in a pocket of a cam and half in an opening in the sleeve if it is not engaged.

Defined even more broadly, the present invention is an integrated resistance spring force machine comprising: (a) a plurality of internal transverse sections with each section having a respective constant force spring to output a respective magnitude of a spring resistance force which serves as the respective force loads when in use, and a force selection mechanism which is used to selectively activate one or more respective constant force springs so that the respective force loads of the selected constant force springs can be output to a combined level of resistance; (b) each of the internal transverse sections has a structural configuration comprising a central pulley connected to first and second flat constant force springs which are respectively connected to respective first and second side pulleys so that the first and second springs will expand and each will apply a constant force to the central pulley if the central pulley is in rotation; and (c) the force selection mechanism comprised of means by which at least one respective pulley of one or more internal transverse sections is engaged to thereby cause a resistance force from the constant force springs associated with that internal transverse section to be engaged.

Defined even more broadly, the present invention is an integrated resistance spring force machine comprising: (a) a plurality of internal transverse sections with each section having a respective constant force spring to output a respective magnitude of a spring resistance force which serves as the respective force loads when in use, and a force selection mechanism which is used to selectively activate one or more respective constant force springs so that the respective force loads of the selected constant force springs can be output to a combined level of resistance; (b) each of the internal transverse sections has a structural configuration comprising a central pulley connected to at least one constant force spring which is connected to a respective side pulley so that the spring will expand and will apply a constant force to the central pulley if the central pulley is in rotation; and (c) the force selection mechanism comprised of means by which at least one respective pulley of one or more internal transverse sections is engaged to thereby cause a resistance force from the at least one constant force spring associated with that internal transverse section to be engaged.

Defined even more broadly, the present invention is an integrated resistance spring force assembly machine comprising: (a) a plurality of internal transverse sections with each section having a respective constant force spring to output a respective magnitude of a spring resistance force, which serves as the respective force loads when in use, and a force selection mechanism which can be used to selectively activate the respective springs so that the respective force loads can be output to a combined level of resistance for an exercise routine; (b) each of the internal transverse sections has a structural configuration comprising a central pulley engaging at least one constant force spring so that the spring will expand and will apply a constant force to the central pulley if the central pulley is in rotation; and (c) the force selection mechanism comprised of means by which at least one respective pulley of one or more internal transverse sections is engaged to thereby cause a resistance force from the constant force spring associated with that internal transverse section to be engaged.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An integrated resistance spring force machine comprising:

a. a plurality of internal transverse sections with each section having a respective constant force spring to output a respective magnitude of a spring resistance force which serves as the respective force loads when in use, and a force selection mechanism which is used to selectively activate one or more respective constant force springs so that the respective force loads of the selected constant force springs can be output to a combined level of resistance;

b. each of the internal transverse sections has an identical structural configuration comprising a central pulley connected to first and second identical flat constant force springs which are respectively connected to respective first and second side pulleys, each central pulley having a pair of oppositely disposed internal grooves, wherein the position of the first spring is symmetric to the position of the second spring relative to a center of the central pulley so that the first and second springs will expand and each will apply an identical constant force to the central pulley if the central pulley is in rotation;

c. the force selection mechanism comprised of a plurality of cams positioned in a given relationship to the respective central pulleys, wherein each cam is a cylindrical structure comprising a central square opening and an exterior cylindrical surface with a plurality of alternating pockets and plateaus positioned around respective upper and lower circumferences of the exterior surface of each cam, respective upper and lower ball bearings which are movably received in the respective upper and lower circumferences of each cam so that half of the respective ball bearings will be either in or out of the pockets when its respective cam is rotated;

d. an elongated force selection square shaft that penetrates through the central openings of the respective cams, a cylindrical housing that surrounds the cams and serves as a housing for the cams, and a force selection knob which is mated with a collar and coordinated with the cams to cause the cams to rotate by a given turn when the force selection knob is rotated by a given rotational turn; and e. the cylindrical housing comprised of first and second longitudinal sets of transverse longitudinally spaced apart openings on a cylindrical wall of the housing, wherein each opening from the first set is positioned 180 degrees apart from each opening in the second set, the respective transverse openings of the first longitudinal set are respectively positioned to match the upper circumferences of the respective cams and the transverse openings of the second longitudinal set are respectively positioned to match the lower circumferences of the respective cams so that some of the ball bearings of the respective cams will be aligned with a plateau of a cam and thereby half of such ball bearings will be pushed so that it rests partially in a respective transverse opening of the housing and partially in an internal groove of the central pulley, and half of some of the ball bearings will remain in a pocket of a cam and half of the ball bearings will remain in an opening of the housing if a plateau is not aligned with an opening in the housing whereby the engagement of a ball bearing in an opening of the housing and a corresponding internal groove of the central pulley causes a resistance force from the constant force springs associated with that cam to be engaged.

2. The integrated resistance spring force machine in accordance with claim 1 further comprising an exterior force outputting pulley connected to a force transferring means by which the integrated resistance spring force machine is connected to an exercise apparatus to thereby provide selected resistance spring forces to the exercise apparatus.

3. The integrated resistance spring force machine in accordance with claim 1 further comprising an exterior cover surrounding the plurality of internal transverse sections.

4. The integrated resistance spring force machine in accordance with claim 1 wherein the plurality of internal transverse sections are aligned in a row so that the central pulleys of all sections are aligned, the first side pulleys of all sections are aligned and the second side pulleys of all sections are aligned.

5. The integrated resistance spring force machine in accordance with claim 4 further comprising a spacer separating each central pulley of the internal transverse section from the central pulley of an adjacent internal transverse section.

6. The integrated resistance spring force machine in accordance with claim 1 further comprising five internal transverse sections.

7. The integrated resistance spring force machine in accordance with claim 6 wherein a first internal transverse section comprises a resistance force of five pounds, a second internal transverse section comprises a resistance force of ten pounds, a third internal transverse section comprises a resistance force of twenty pounds, a fourth internal transverse section comprises a resistance force of twenty-five pounds, and a fifth internal transverse section comprises a resistance force of fifty pounds.

8. An integrated resistance spring force machine comprising:

a. a plurality of internal transverse sections with each section having a respective constant force spring to output a respective magnitude of a spring resistance force which serves as the respective force loads when in use, and a force selection mechanism which is used to selectively activate one or more respective constant force springs so that the respective force loads of the selected constant force springs can be output to a combined level of resistance;

b. each of the internal transverse sections has a structural configuration comprising a central pulley connected to first and second flat constant force springs which are respectively connected to respective first and second side pulleys so that the first and second springs will expand and each will apply a constant force to the central pulley if the central pulley is in rotation, each central pulley having a pair of spaced apart engagement mechanisms;

c. the force selection mechanism comprised of a plurality of cams positioned in a given relationship to the respective central pulleys, wherein each cam is comprised of a central opening and an exterior surface with a plurality of alternating pockets and plateaus positioned around respective upper and lower areas of the exterior surface of each cam, respective upper and lower ball bearings which are movably received in the respective upper and lower area of the exterior surface of each cam so that half of the respective ball bearings will be either in a pocket or out of a pocket and on a plateau when its respective cam is rotated;

d. an elongated force selection shaft that penetrates through the central openings of the respective cams, an external sleeve that surrounds the cams and serves as a housing for the cams, and a force selection knob which is coordinated with the cams to cause the cams to rotate by a given turn when the force selection knob is rotated by a given rotational turn; and e. the sleeve comprised of first and second longitudinal sets of transverse longitudinally spaced apart openings on a wall of the sleeve, wherein each opening from the first set is positioned at a given distance apart from each opening in the second set, the respective transverse openings of the first longitudinal set are respectively positioned to match the upper surface areas of the respective cams on a respective engagement mechanism of the central pulley and the transverse openings of the second longitudinal set are respectively positioned to match the lower surface areas of the respective cams and a respective engagement mechanism of the central pulley so that half of selected of the ball bearings of the respective cams will be pushed from a plateau into the respective transverse openings of the sleeve and corresponding engagement mechanism of the central pulley, half of some of the ball bearings will remain in a pocket of a cam and half in a transverse opening of the sleeve if a plateau is not aligned with an opening in the sleeve whereby the engagement of a half of a ball bearing in an opening of a sleeve and half of a ball bearing in a corresponding engagement mechanism of the central pulley cause a resistance force from the constant force springs associated with that cam to be engaged.

9. The integrated resistance spring force machine in accordance with claim 8 further comprising means by which the integrated resistance spring force machine is connected to an exercise apparatus to thereby provide selected resistance spring forces to the exercise apparatus.

10. The integrated resistance spring force machine in accordance with claim 8 further comprising an exterior cover surrounding the plurality of internal transverse sections.

11. The integrated resistance spring force machine in accordance with claim 8 wherein the plurality of internal transverse sections are aligned in a row so that the central pulleys of all sections are aligned, the first side pulleys of all sections are aligned and the second side pulleys of all sections are aligned.

12. The integrated resistance spring force machine in accordance with claim 11 further comprising a spacer separating each central pulley of the internal transverse section from the central pulley of an adjacent internal transverse section.

13. The integrated resistance spring force machine in accordance with claim 8 further comprising five internal transverse sections.

14. The integrated resistance spring force machine in accordance with claim 13 wherein a first internal transverse section comprises a resistance force of five pounds, a second internal transverse section comprises a resistance force of ten pounds, a third internal transverse section comprises a resistance force of twenty pounds, a fourth internal transverse section comprises a resistance force of twenty-five pounds, and a fifth internal transverse section comprises a resistance force of fifty pounds.

15. An integrated resistance spring force machine comprising:

a. a plurality of internal transverse sections with each section having a respective constant force spring to output a respective magnitude of a spring resistance force which serves as the respective force loads when in use, and a force selection mechanism which is used to selectively activate one or more respective constant force springs so that the respective force loads of the selected constant force springs can be output to a combined level of resistance;

b. each of the internal transverse sections has a structural configuration comprising a central pulley connected to at least one constant force spring which is connected to at least one side pulley so that the at least one spring will expand and will apply a constant force to the central pulley if the central pulley is in rotation;

c. the force selection mechanism comprised of a plurality of cams positioned in a given relationship to the respective central pulleys, wherein each cam is comprised of a central opening and an exterior surface with a plurality of pockets positioned around an area of the exterior surface of each cam, respective ball bearings which are movably received in the respective area of the exterior surface of each cam so that half of the respective ball bearings will be either in or out of the pockets when its respective cam is rotated;

d. an elongated force selection shaft that penetrates through the central openings of the respective cams, an external sleeve that surrounds the cams and serves as a housing for the cams, and a force selection knob which is coordinated with the cams causes the cams to rotate by a given turn when the force selection knob is rotated by a given rotational turn; and e. the sleeve comprised of at least one set of transverse longitudinally spaced apart openings on a wall of the sleeve, the respective transverse openings are respectively positioned to match the exterior surface area containing pockets of each respective cam so that half of some of the ball bearings of the respective cams will be pushed into the respective transverse openings of the sleeve and each central pulley having at least one engagement mechanism which receives half of a ball bearing if it is pushed out of a pocket and into an opening in the sleeve, whereby the engagement of half of a ball bearing in an opening of a sleeve and half of a ball bearing pushed into the engagement mechanism of the central pulley causes a resistance force from the at least one constant force spring associated with that cam to be engaged, and some of half of the ball bearings will remain in a pocket of a cam and half in an opening in the sleeve if it is not engaged.

16. The integrated resistance spring force machine in accordance with claim 15 further comprising means by which the integrated resistance spring force machine is connected to an exercise apparatus to thereby provide selected resistance spring forces to the exercise apparatus.

17. The integrated resistance spring force machine in accordance with claim 15 wherein the plurality of internal transverse sections are aligned in a row so that the central pulleys of all sections are aligned.

* * * * *